US009031454B2

(12) United States Patent
Nakamura

(10) Patent No.: US 9,031,454 B2
(45) Date of Patent: May 12, 2015

(54) IMAGE FORMING APPARATUS CAPABLE OF GUIDING A LATENT IMAGE FORMING DEVICE

(71) Applicant: Kenji Nakamura, Osaka (JP)

(72) Inventor: Kenji Nakamura, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/941,730

(22) Filed: Jul. 15, 2013

(65) Prior Publication Data

US 2014/0044450 A1 Feb. 13, 2014

(30) Foreign Application Priority Data

Aug. 7, 2012 (JP) ..... 2012-175343

(51) Int. Cl.
*G03G 15/00* (2006.01)
*G03G 21/16* (2006.01)

(52) U.S. Cl.
CPC ..... *G03G 21/1623* (2013.01); *G03G 21/1633* (2013.01); *G03G 21/1647* (2013.01); *G03G 21/1666* (2013.01)

(58) Field of Classification Search
CPC ..... G03G 21/1623; G03G 21/1666
USPC ..... 399/110
See application file for complete search history.

(56) References Cited

U.S. PATENT DOCUMENTS

| | | | | |
|---|---|---|---|---|
| 2009/0058978 | A1* | 3/2009 | Itabashi | 347/152 |
| 2013/0278705 | A1* | 10/2013 | Nakamura et al. | 347/238 |
| 2013/0315625 | A1* | 11/2013 | Fujita et al. | 399/125 |
| 2013/0322919 | A1* | 12/2013 | Wei et al. | 399/111 |
| 2014/0064781 | A1* | 3/2014 | Hashimoto et al. | 399/110 |

FOREIGN PATENT DOCUMENTS

| | | |
|---|---|---|
| JP | 2007-065125 | 3/2007 |
| JP | 2010-044406 | 2/2010 |
| JP | 2010-271743 | 12/2010 |

* cited by examiner

*Primary Examiner* — Billy Lactaoen
*Assistant Examiner* — Arlene Heredia Ocasio
(74) *Attorney, Agent, or Firm* — Harness, Dickey & Pierce, P.L.C.

(57) ABSTRACT

The present invention provides an image forming apparatus including a housing including an opening; an inner cover as a holder; a photoreceptor as a latent image carrier; and a recording head as a latent image forming device, to form a latent image on the photoreceptor, supported by the holder swingably about an end of the holder relative to the housing. The recording head moves between a latent image forming position and a retracted position when the holder moves to be opened or closed. The image forming apparatus further includes a first guide member at a first end to guide the recording head longitudinal end at a first end to the latent image forming position; and a second guide member at a second end to guide the recording head longitudinal second end, of which the length of the second guide member is shorter than the length of the first guide member.

24 Claims, 12 Drawing Sheets

IMAGE FORMING APPARATUS CAPABLE OF GUIDING A LATENT IMAGE FORMING DEVICE

CROSS-REFERENCE TO RELATED APPLICATION

The present application claims priority pursuant to 35 U.S.C. §119 from Japanese patent application number 2012-175343, filed on Aug. 7, 2012, the entire disclosure of which is incorporated by reference herein.

BACKGROUND

1. Technical Field

The present invention relates to an image forming apparatus such as a printer, a facsimile machine, or a copier.

2. Related Art

Conventionally, a so-called tandem type image forming apparatus has been known, in which a plurality of latent image carriers are disposed along a surface moving direction of an intermediate transfer member or a recording medium conveyance member. The tandem-type image forming apparatus further includes, around each latent image carrier, a charger to uniformly charge a surface of the latent image carrier, a recording head to expose the surface of the latent image carrier to form a latent image, and a developing device to develop the latent image formed on the latent image carrier.

JP-4781753-B and JP-2010-271743-A disclose an image forming apparatus including an upper cover rotatably disposed on the apparatus housing as a holder to hold a plurality of recording heads. The upper cover is so disposed as to rotate about an end of the housing and parallel to the plurality of latent image carriers. When the upper cover is closed, the plurality of recording heads is positioned at a latent image forming position where the latent image is formed on the surface of the latent image carrier. If the upper cover is opened, the plurality of recording heads moves from the latent image forming position to a retracted position.

When the recording head moves to the retracted position, an image forming unit including the latent image carrier, the charger, and the developing device can be pulled out vertically, so that the image forming unit can be pulled out from an upper opening of the housing.

FIG. 16 is a schematic view of an example of an image forming apparatus and represents a state in which an upper cover 50 is opened and image forming units are taken out.

In the image forming apparatus as background art as illustrated in FIG. 16, an inner cover 40 to hold each of the recording heads 70Y, 70M, 70C, and 70K and the upper cover 50 are so disposed as to rotate about a shaft 50. Each recording head 70Y, 70M, 70C, or 70K is rotatable with respect to the inner cover 40 via a pair of arm members 76Y, 76M, 76C, and 76K. One of the pair of arm members retains one longitudinal end of the recording head and the other retains the other longitudinal end of the recording head.

Further, the inner cover 40 includes toner cartridges, not shown, containing toner to be supplied. When the upper cover 50 and the inner cover 40 are rotated counterclockwise in FIG. 16, image forming units 1Y, 1M, 1C, and 1K disposed inside the housing 90 are exposed and can be taken out from the upper part.

Side plates are disposed at both lateral ends of the recording head in the longitudinal direction, that is, a main scanning direction. One side plate is opposed to one longitudinal end of the recording head and the other side plate is opposed to the other longitudinal end of the recording head. Guide members 91Y, 91M, 91C, and 91K each extend from a latent image position of the recording head toward an opening of the housing.

When the inner cover 40 is being closed, each recording head moves along an arc-shaped moving locus about a rotary supporting point of the inner cover 40. Each recording head 70Y, 70M, 70C, or 70K includes a projection 72Y, 72M, 72C, or 72K, respectively, each as a guided portion disposed at each arm member. In associated movement of closing the inner cover 40, each recording head 70Y, 70M, 70C, or 70K enters into the housing and the projection 72Y, 72M, 72C, or 72K contacts each guide member 91Y, 91M, 91C, or 91K. When the inner cover 40 is further closed, the guide member regulates the arc-shaped moving of each recording head with its center at the rotary supporting point of the inner cover 40. Accordingly, when the recording head moves along the arc-shaped moving locus in the housing, each recording head moves downward while moving leftward (toward the shaft 51). When the guided portion abuts the guide member, moving toward the left is regulated. Because each recording head is disposed swingably relative to the inner cover, if the moving toward left is regulated by the guide member, the recording head moves counterclockwise relative to the inner cover 40, so that each recording head moves downward to the latent image forming position guided by the guide member.

The image forming apparatus includes a first guide member disposed at one end or a first end to guide one end of the recording head to the latent image forming section; and a second guide member disposed at the other end or a second end to guide the other end of the recording head to the latent image forming position. Each guide member extends from the latent image forming position to the position close to the opening of the housing. Accordingly, a space for a drive transmission device such as a gear to transmit driving force of a motor to the toner bottle cannot be obtained around a side wall opposite the second end of the recording head in the housing. Provision of such a device in the subject area may lead to a large-sized apparatus.

SUMMARY

The present invention provides a compact image forming apparatus capable of guiding the latent image forming device to the latent image forming position optimally, that includes a latent image carrier; a latent image forming device to form a latent image on a surface of the latent image carrier; a housing including an opening which includes the latent image carrier and the latent image forming device; a holder swingably supporting the latent image forming device, the holder being swingably supported about an end thereof relative to the housing and moving the latent image forming device between a latent image forming position and a retracted position; a first guide member at a first end extending from the latent image forming position to the opening of the housing and configured to guide the latent image forming device longitudinal end at a first end to the latent image forming position while regulating movement of the latent image forming device in the vertical direction; and a second guide member at a second end extending from the latent image forming position to the opening of the housing and configured to guide the latent image forming device longitudinal end at a second end to the latent image forming position while regulating movement of the latent image forming device in the vertical direction. In the image forming apparatus, the length of the second guide member from the latent image forming position to an end toward the opening is shorter than the length of the first guide member from the latent image forming position to the end toward the opening of the housing.

These and other objects, features, and advantages of the present invention will become apparent upon consideration of the following description of the preferred embodiments of the present invention when taken in conjunction with the accompanying drawings.

DETAILED DESCRIPTION

Hereinafter, a first embodiment of an image forming apparatus employing an electrophotographic method will be described. In this embodiment, the apparatus is a printer.

Figure 1:
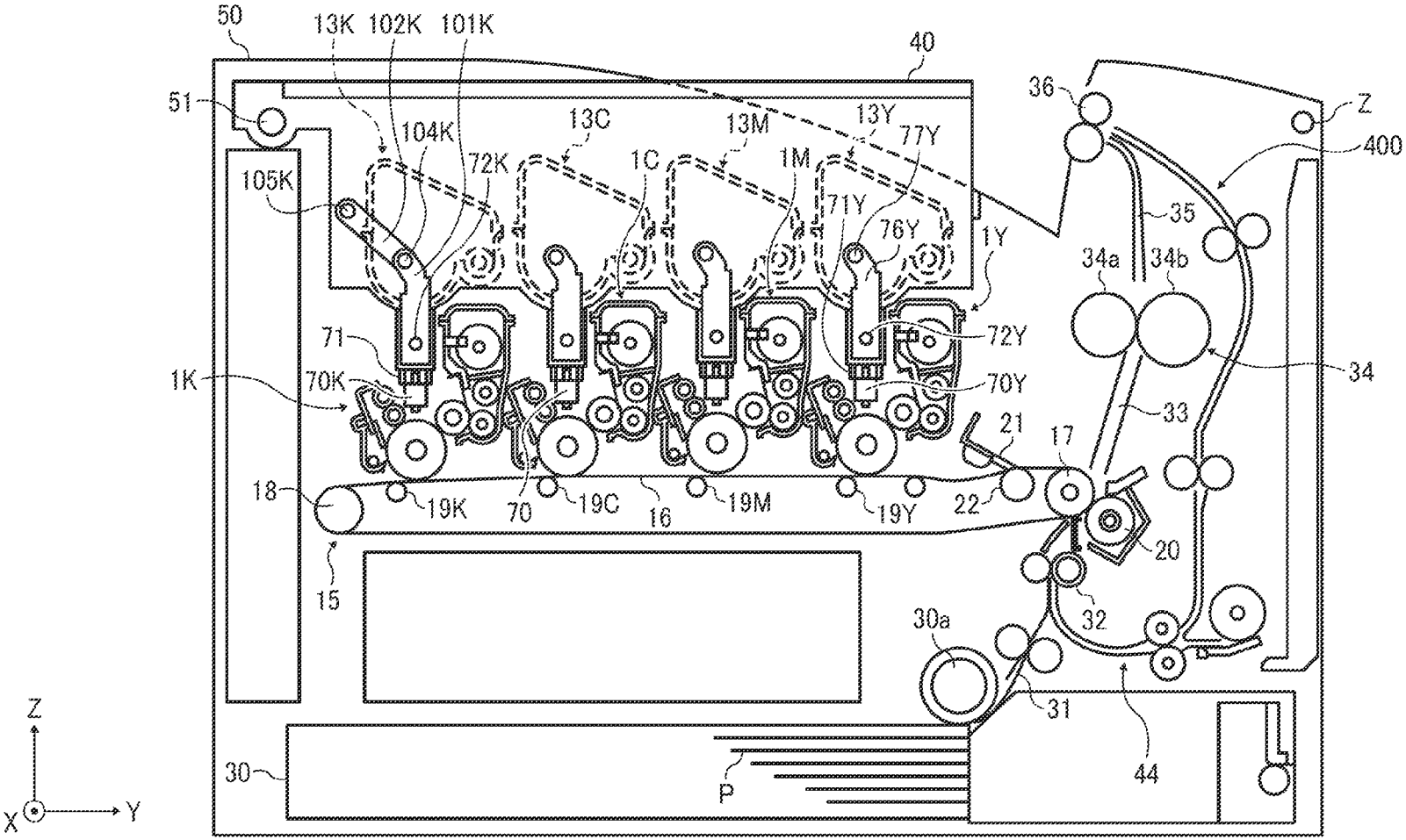
FIG. 1 is a schematic diagram of a printer according to an embodiment of the present invention.

First, a basic configuration of the printer will be described. FIG. 1 shows a schematic configuration of the printer. As illustrated in FIG. 1, the present printer includes four image forming units 1Y, 1M, 1C, and 1K to form a toner image of respective colors of yellow (Y), magenta (M), cyan (C), and black (K). Except that the image forming units employ toner with different colors Y, M, C, and K from each other, all the image forming units are similarly configured and are replaced when they expire. Accordingly, only the image forming unit 1K to form a K toner image will be described as an example.

Figure 2:
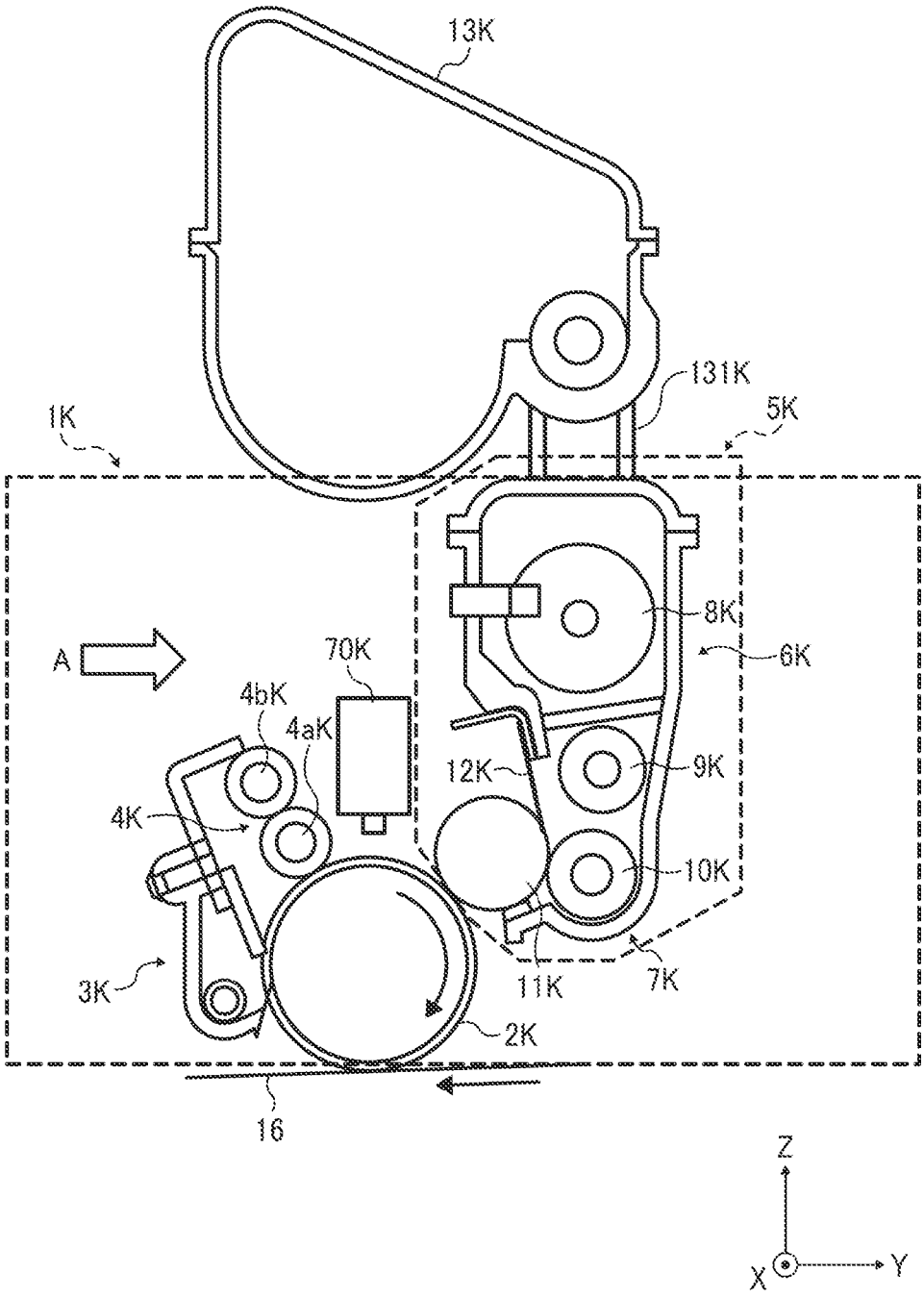
FIG. 2 is an enlarged view of an image forming unit 1K included in the printer of FIG. 1.

As illustrated in FIG. 2, the image forming unit 1K includes: a drum-shaped photoreceptor 2K serving as a latent image carrier; a drum cleaner 3K; a discharger (not shown); a charger 4K, a recording head 70K as a latent image forming means; and a developing device 5K. Each image formation unit 1K is detachably disposed on the printer main body and is replaceable when consumed.

The charger 4K includes a charging roller 4*a*K and a recovery roller 4*b*K. The photoreceptor 2K rotates clockwise via a driving means, not shown. The charging roller 4*a*K rotates counterclockwise while contacting the photoreceptor 2K. Electrical discharge is generated between the charging roller 4*a*K and the photoreceptor 2K so that a surface of the photoreceptor 2K is uniformly charged.

The thus-uniformly-charged surface of the photoreceptor 2K is exposed by the recording head 70K, so as to carry an electrostatic latent image for the K-color. The electrostatic latent image of K-color is developed into a K-toner image by the developing device 7K using the K-toner, not shown. The K-toner image is then transferred to an intermediate transfer belt 16, which will be described later.

The drum cleaner 3K removes residual toner deposited on the surface of the photoreceptor 2K after the intermediate transfer process. The removed residual toner is conveyed by a screw member to an end of the casing of the image forming unit 1K and is discharged from the casing and is collected in a waste toner bottle, not shown.

The discharger, not shown, serves to electrically discharge a residual potential of the photoreceptor 2K after the cleaning process. By this discharging operation, the surface of the photoreceptor 2K is initialized and becomes ready for a next image formation. Other image forming units (1Y, 1M, and 1C) similarly form toner images of each color of Y, M, or C on corresponding one of photoreceptors (2Y, 2M, and 2C). The thus-formed toner images are transferred to the intermediate transfer belt 16 as an intermediate process.

The developing device 5K includes a longitudinal hopper 6K to contain K-toner, not shown, and a developing unit 7K. Inside the hopper 6K, there are provided: an agitator 8K, an agitation paddle 9K, a toner supply roller 10K, and the like. The agitator 8K is rotatably driven by a driving means, not shown. The agitation paddle 9K is disposed vertically below the agitator 8K and is rotatably driven by a driving means, not shown. The toner supply roller 10K is further disposed vertically below the agitation paddle 9K and is rotatably driven by a driving means, not shown. The K-toner in the hopper 6K is agitated by a rotary drive of the agitator 8K and the agitation paddle 9K and is moved toward the toner supply roller 10K by its own weight. The toner supply roller 10K includes a metal core and a roller portion formed on the surface of the metal core and formed of foamed resins. The toner supply roller 10K rotates while having the K-toner in the hopper 6K adhered on its roller surface thereof.

Inside the developing unit 7K of the developing device 5K, a developing roller 11K rotating while contacting the photoreceptor 2K and the toner supply roller 10K, and a thin-layer blade 12K of which a tip end contacts the developing roller 11 are disposed. The K-toner adhered onto the toner supply roller 10K inside the hopper 6K is supplied to the developing roller 11K by a contact between the developing roller 11K and the toner supply roller 10K. The supplied K-toner on the surface of the developing roller 11K is spread to form a thin layer when passing through the contact position between the developing roller 11K and the thin layer forming blade 12K. Then, the K-toner after its layer height being regulated comes to a developing area in the contact portion between the developing roller 11K and the photoreceptor 2K and adheres onto the electrostatic latent image for K-color on the surface of the photoreceptor 2K. Due to the adhesion of toner, the electrostatic latent image for K-color is rendered to be the K-color toner image.

The recording head 70K includes a plurality of light-emitting elements such as LED or organic EL elements disposed along the longitudinal direction of the photoreceptor 2K; and a rod lens disposed between the photoreceptor 2K and the light emitting elements along the longitudinal direction of the photoreceptor 2K. The recording head 70K allows the light emitting elements at a predetermined position to emit laser beams based on the image information via the rod lens so as to expose the photoreceptor 2K, thereby forming an electrostatic latent image for K-color on the photoreceptor 2K.

A toner cartridge 13K containing the toner to be replenished is disposed vertically above the image forming unit 1K. The toner cartridge 13K, which is actually the bottle, and the developing device 5K are connected via a supply tube 131K. The supply toner inside the toner cartridge 13K is replenished to the developing device 5K if needed.

The image forming unit for K-color has been described heretofore referring to FIG. 2. The other image forming units 1Y, 1M, and 1C similarly form Y-, M-, and C-toner images according to the similar processes on each surface of the photoreceptors 2Y, 2M, and 2C.

Referring back to FIG. 1, a transfer unit 15 is disposed vertically below the image forming units 1Y, 1M, 1C, and 1K, and allows an endless intermediate transfer belt 16 that extends and is stretched, to move endlessly in the counterclockwise direction. The transfer unit 15 includes, other than the intermediate transfer belt 16, a drive roller 17, a driven roller 18, four primary transfer rollers 19Y, 19M, 19C, and 19K, a secondary transfer roller 20, a belt cleaner 21, a cleaner backup roller 22, and the like.

The intermediate transfer belt 16 is supported stretchably by the drive roller 17, the driven roller 18, and the cleaner backup roller 22, which are disposed at an inner side of the loop of the belt, and four primary transfer rollers 19Y, 19M, 19C, and 19K. The thus-configured intermediate transfer belt 16 is endlessly moved in the counterclockwise direction driven by the drive roller 17 rotating counterclockwise by a driving force of a driving means, not shown.

The endlessly moving intermediate transfer belt 16 is sandwiched between the four primary transfer rollers 19Y, 19M, 19C, and 19K and the photoreceptors 2Y, 2M, 2C, and 2K, respectively. This sandwiched structure enables formation of a primary transfer nip for Y-, M-, C-, or K-color at each position where an outer surface of the intermediate transfer belt 16 contacts each of the photoreceptors 2Y, 2M, 2C, and 2K.

Each of the primary transfer rollers 19Y, 19M, 19C, and 19K is supplied with a primary transfer bias from a transfer bias power source, not shown, which enables transfer of an electric field generated between the electrostatic latent image on the photoreceptors 2Y, 2M, 2C, and 2K and the primary transfer rollers 19Y, 19M, 19C, and 19K, respectively. In place of the primary transfer rollers 19Y, 19M, 19C, and 19K, a transfer charger or a transfer brush may be used.

The Y-toner image formed on the surface of the photoreceptor 2Y of the image forming unit 1Y for Y-color enters into the primary transfer nip for Y-color associated with a rotation of the photoreceptor 2Y, and is primarily transferred on the intermediate transfer belt 16 from the photoreceptor 2Y due to effect of the transfer electric field and a nip pressure. The surface of the intermediate transfer belt 16 on which the Y-toner image has been transferred passes through the primary transfer nip for M-, C-, and K-colors according to the endless movement of the belt, and the M-, C-, and K-toner images on the photoreceptors 2M, 2C, and 2K have been sequentially, primarily transferred on the Y-toner image in a superimposed manner. With the superimposing primary transfer, a four-color toner image is formed on the intermediate transfer belt 16.

The secondary transfer roller 20 of the transfer unit 15 is positioned outside the loop of the intermediate transfer belt 16 and includes the intermediate transfer belt 16 sandwiched between the drive roller 17 disposed inside the loop and the secondary transfer roller 20 itself. With this sandwiched structure, a secondary transfer nip is formed at a portion where an outer surface of the intermediate transfer belt 16 contacts the secondary transfer roller 20. The secondary transfer roller 20 is supplied with a secondary transfer bias from a transfer bias power supply, not shown. With this application, a secondary transfer electric field is formed between the secondary transfer roller 20 and the drive roller 17, which is grounded.

A paper tray 30 containing a plurality of recording sheets P is disposed vertically below the transfer unit 15. The paper try 30 is slidably disposed in the housing of the printer and attachably detachable therefrom. A sheet feed roller 30*a* is so disposed as to contact a topmost sheet of the stack of the recording sheets P and starts to rotate counterclockwise at a predetermined timing so that the recording sheet P is sent toward a sheet conveyance path 31 one after another.

A registration roller pair 32 is disposed at an end of the sheet conveyance path 31. The registration roller pair 32 stops rotation of the two rollers when the recording sheet P conveyed from the paper tray 30 is sandwiched between the rollers. Then, the registration roller pair 32 restarts rotary driving and sends the sandwiched recording sheet to the secondary transfer nip so that the recording sheet P is synchronized with the 4-color toner image on the intermediate transfer belt 16 at the secondary transfer nip.

The four-color toner image on the intermediate transfer belt 16 which has been closely contacted against the recording sheet P at the secondary transfer nip is transferred en bloc onto the recording sheet P under the effects of secondary transfer electric field and nip pressure, so that a full-color toner image is formed on the recording sheet P with added performance from white color of the sheet P. The recording sheet P on which a full-color toner image is formed is then separated from the secondary transfer roller 20 or the intermediate transfer belt 16 due to the curvature radius of the roller or the belt when passing through the secondary transfer nip. After the above transferring process, the recording sheet P is sent into a fuser 34, which will be described later, via the conveyance path 33.

Residual toner which has not been transferred to the recording sheet P is adhered to the intermediate transfer belt 16 which has passed through the secondary transfer nip. The belt cleaner 21 contacts the outer surface of the intermediate transfer belt 16, and the residual toner is cleaned from the surface of the intermediate transfer belt 16 by the belt cleaner 21. The cleaner backup roller 22 is disposed on an inner loop of the intermediate transfer belt 16 and supports the cleaning process of the belt by the belt cleaner 21 from the inner side of the belt loop.

The fuser 34 includes a fuser roller 34*a* including a built-in heat source such as a halogen lamp, not shown, and a pressure roller 34*b* rotating while contacting the fuser roller 34*a* with a predetermined pressure so that a fixing nip is formed between the fuser roller 34*a* and the pressure roller 34*b*. An unfixed toner image carrying surface of the recording sheet P which has been sent into the fuser 34 is closely contacted against the fuser roller 34*a* and is sandwiched at the fixing nip. Toner in the toner image is melted due to the heat and pressure so that a full-color image is fixed onto the recording sheet P.

The recording sheet P is then discharged from the fuser 34, passes through a conveyance path 35, and is sandwiched between a sheet discharge roller pair 36.

When a single-side printing mode has been set by the input via numeric keys on the control panel of the apparatus or by control signals from a computer, the recording sheet P sandwiched by the sheet discharge roller pair 36 is discharged directly outside the image forming apparatus. Then, the recording sheet P is stacked on the sheet stacking section on an upper surface of the upper cover 50.

On the other hand, if a duplex printing mode has been set, when a trailing end of the recording sheet P conveyed while a leading end thereof being sandwiched between the sheet discharge roller pair 36 passes through the conveyance path 35 after the fusing process, an end portion of the conveyance path 35 is closed by a switching claw, not shown. At substantially the same time, the sheet discharge roller pair 36 starts to rotate inversely. Then, the recording sheet P is conveyed with the trailing end directed ahead and enters into a before-reversing conveyance path 400.

When the sheet discharge roller pair 36 rotates inversely, the recording sheet P enters into the before-reversing conveyance path 400 and is conveyed vertically down from above. Then, the recording sheep P enters into a reversing conveyance path 44 curving in a semicircle. Further, the recording sheet P is conveyed along the curved shape while face down and a conveying direction vertically down from above being reversed, and is conveyed vertically from bottom to above. Then, after passing through the sheet conveyance path 31, the recording sheet P again enters into the secondary transfer nip. Then, a full-color image is again secondarily transferred en bloc to the other side of the recording sheet P. Thereafter, the recording sheet P is sequentially conveyed from the conveyance path 33 after transfer, the fuser 34, the conveyance path 35 after fixation, to the sheet discharge roller pair 36, and is discharged outside the apparatus.

The upper cover 50 above the housing of the printer is rotatably supported about the shaft 51. The upper cover 50 is open when rotated counterclockwise in the figure. In this state, the upper portion of the apparatus is largely exposed through the opening.

Toner cartridges 13Y, 13M, 13C, and 13K and recording heads 70Y, 70M, 70C, and 70K are held in the inner cover 40 serving as a support member. The upper cover 40 is also supported to rotate pivotally about the shaft 51. When the inner cover 40 rotates counterclockwise in the figure, the interior of the apparatus is exposed, exposing the image forming units 1Y, 1M, 1C, and 1K disposed inside the apparatus.

The toner cartridges 13Y, 13M, 13C, and 13K can be replaced in a state in which the upper cover 50 is open. The image forming units 1Y, 1M, 1C, and 1K can be replaced in a state in which the upper cover 50 and the inner cover 40 are open.

In the present embodiment, a supporting point of the rotation of the inner cover 40 and the upper cover 50 is set at an edge opposite the right-side end of the conveyance path of the recording sheet P. If the rotary supporting point for the upper cover 50 and the inner cover 40 is disposed at a position Z in the figure, the upper cover 50 and the inner cover 40 would extend from the rotary supporting point to the opposite end (i.e., the left side end in the figure). Otherwise, even when the upper cover 50 and the inner cover 40 are opened, the image forming unit for K-color would not be exposed. As a result, the inner cover 40 would be lengthened, and the cost of the parts would be increased. In addition, because the recording sheet P is vertically conveyed according to the present embodiment, if the inner cover 40 is configured to have a rotary supporting point disposed at the position Z, the inner cover 40 might be overlapped with the conveyance path 35 after fixation. As a result, when a paper jam occurs in the conveyance path 35 after fixation, the inner cover 40 may disturb handling processes for the paper jam. Providing the inner cover 40 which does not disturb the conveyance path 35 after fixation requires much attention, thereby making the structure of the inner cover 40 more complicated and increasing the cost of the apparatus. The greater length of the upper cover 50 and the inner cover 40 requires much space above the apparatus for opening the upper cover 50 and the inner cover 40.

On the other hand, if the rotation support point (or the shaft 51) of the upper cover 50 and the inner cover 40 is disposed at the left side in the figure opposite the sheet conveyance section, the image forming units 1Y, 1M, 1C, and 1K can be disposed when the upper cover 50 and the inner cover 40 are opened without extending the upper cover 50 and the inner cover 40 toward the sheet conveyance section. With this structure, compared to a case in which the rotary supporting point for the upper cover 50 and the inner cover 40 is disposed at the sheet conveyance section, the length of the upper cover 50 and the inner cover 40 can be shortened and the parts cost may be reduced reasonably. In addition, compared to a case in which the rotary supporting point of the upper cover 50 and the inner cover 40 is set at the sheet conveyance section, space for opening the upper cover 50 and the inner cover 40 disposed above the apparatus may be reduced. Further, even though a paper jam occurs in the conveyance path 35 after fixation, the inner cover 40 is not disturbing to the paper jam handing process. In addition, because there is no need of providing the inner cover 40 so as not to disturb the conveyance path 35 after fixation, the structure of the inner cover 40 can be simplified and the cost rise of the apparatus may be prevented.

Next, retention of each of the recording heads 70Y, 70M, 70C, and 70K of the inner cover 40 will now be described.

Figure 3:
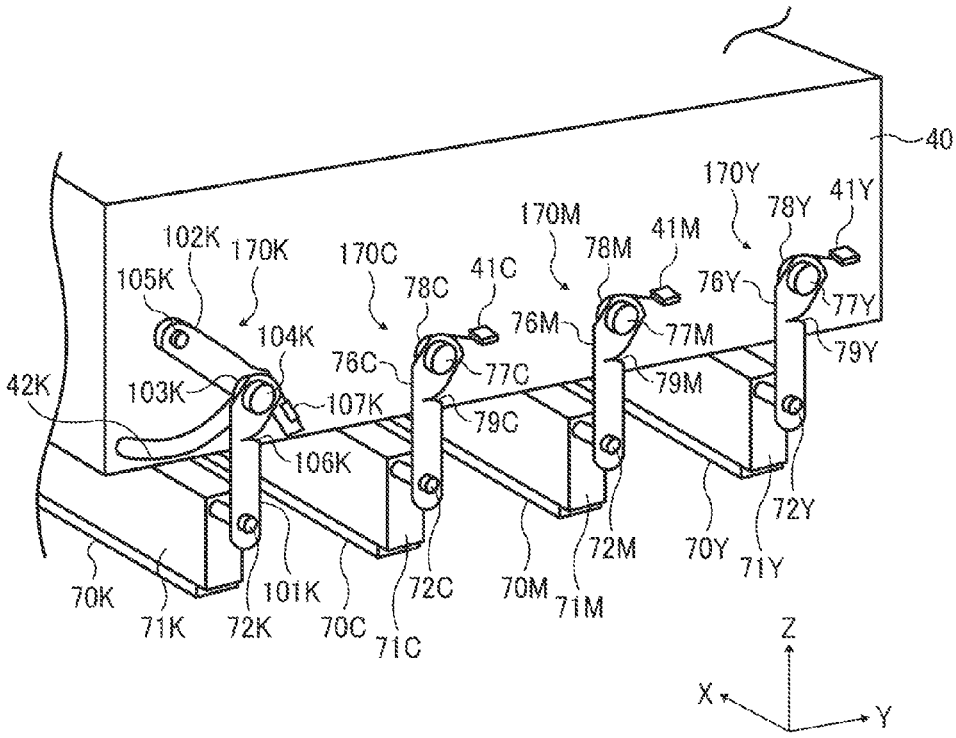
FIG. 3 is a perspective view of an inner cover.
Figure 4:
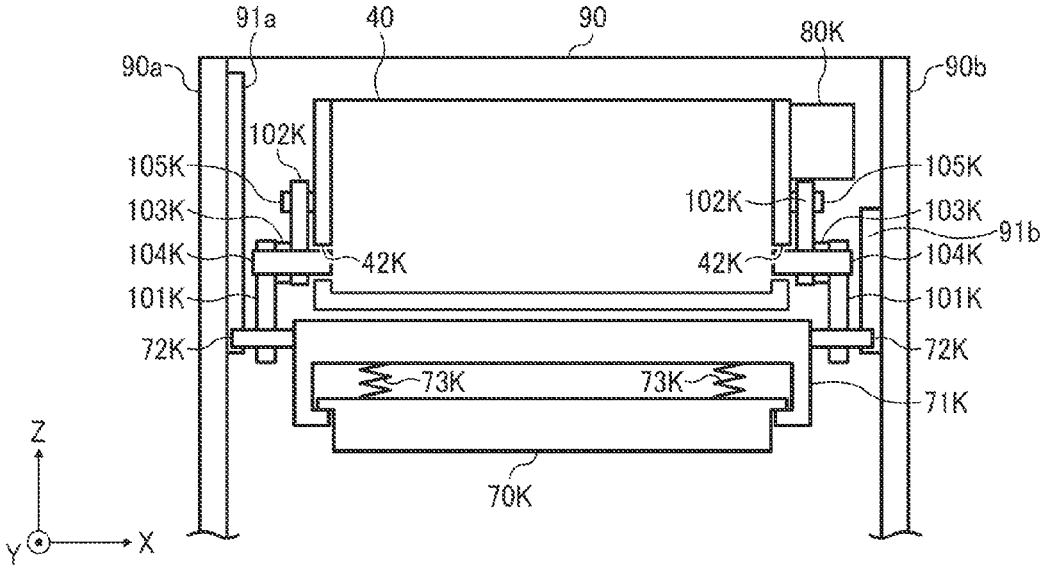
FIG. 4 is a general configuration of an armature for black (K) color.
Figure 5:
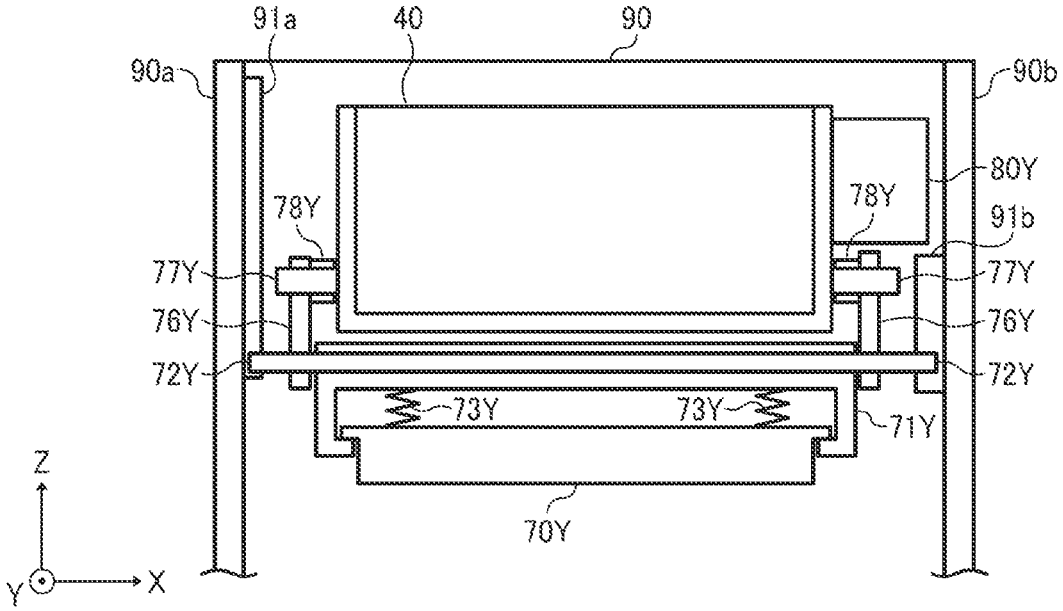
FIG. 5 is a general configuration of an armature for yellow (Y) color.

FIG. 3 is a perspective view of the inner cover 40, FIG. 4 is a schematic view of a K-color armature 170K, and FIG. 5 is a schematic view of a Y-color armature 170Y.

Each recording head 70Y, 70M, 70C, or 70K is rotatably held by each armature 170Y, 170M, 170C, or 170K within a predetermined range of movement with respect to the inner cover 40. The K-color armature 170K for rotatably holding the K-color recording head 70K disposed at a position nearest to the rotary supporting point (the shaft 51), among the plurality of recording heads, is different from other armatures 170K, 170M, and 170C, each of which rotatably holds the other Y-, M-, or C-color recording heads 70Y, 70M, or 70C. The armatures 170Y, 170M, and 170C are similar to each other. Each recording head 70Y, 70M, 70C, or 70K is held by each head holder 71Y, 71M, 71C, and 71K. In addition, as illustrated in FIGS. 4 and 5, recording heads are pressed against the photoreceptor 2 by a spring 73.

Each of the armatures 170Y, 170M, and 170C includes an arm member 76Y, 76M, or 76C and a torsion spring 78Y, 78M, or 78C as a pressing means. Each first rotary member 72Y, 72M, or 72C extends from the head holder 71Y, 71M, or 71C and is rotatably connected to one end of the arm member 76Y, 76M, or 76C. Each second rotary member 77Y, 77M, and 77C is disposed on a side surface of the inner cover 40 and is rotatably connected to the other end of the arm member 76Y, 76M or 76C.

The torsion spring 78Y, 78M, or 78C is sandwiched by the inner cover 40 and the arm member 76Y, 76M, or 76C and is held by the second rotary member 77Y, 77M, or 77C. One end of the torsion spring 78Y, 78M, or 78C strikes a spring receiver 41Y, 41M, or 41C disposed on the side wall of the inner cover 40 and the other end is hooked onto a spring hook 79Y, 79M, or 79C disposed on the arm member 76Y, 76M, or 76C. With this structure, the arm member 76Y, 76M, or 76C is pressed against the shaft 51 by the torsion spring 78Y, 78M, or 78C. In addition, the arm member 76Y, 76M, or 76C rotates by a certain angle via the pressing force of the torsion spring 78Y, 78M, or 78C, and strikes the arm member 76Y, 76M, or 76C, so that the arm member 76Y, 76M, or 76C is prevented from rotating toward a direction pressed by the torsion spring 78Y, 78M, or 78C by a device, not shown, disposed in the inner cover 40.

The K-color armature 170K as an armature which is the closest to the rotary supporting point includes a first arm member 101K, a second arm member 102K, and a torsion spring 103K as a pressing means. The first arm member 101K is configured to be similar to the Y-, M-, and C-color arm members 76Y, 76M, and 76C. A first rotary member 72K extending from the head holder 71K is rotatably attached to one end of the first arm member 101K. A second rotary member 104K fixed on the second arm member 102K at its substantial center thereof is rotatably attached to one end of the first arm member 101K. One end of the second arm member 102K is rotatably attached to a third rotary member 105K disposed on the side wall of the inner cover 40 and the other end thereof is provided with a spring receiver 107K.

The torsion spring 103K is sandwiched by the first arm member 101K and the second arm member 102K and is held by the second rotary member 104K. One end of the torsion spring 103K strikes the spring receiver 107K disposed on the second arm member 102K and the other end is hooked on a spring hook 106K of the first arm member 101K. With this structure, the first arm member 101K is pressed against the shaft 51 by the torsion spring 103K. In addition, the first arm member 101K rotates by a certain angle by the pressing force of the torsion spring 103K, and strikes the first arm member 101K, so that the first arm member 101K is prevented from rotating toward a direction pressed by the torsion spring 103K by a device, not shown, disposed in the second arm member 102K.

As illustrated in FIGS. 3 and 4, the second rotary member 104K is configured to pass through the second arm member 102K and an arc-shaped guide hole 42K disposed on the inner cover 40. In addition, as illustrated in FIGS. 4 and 5, each drive transmission device 80Y, 80M, 80C, or 80K to transmit driving force to the toner bottle is disposed on a side wall of the inner cover 40.

Figure 6:
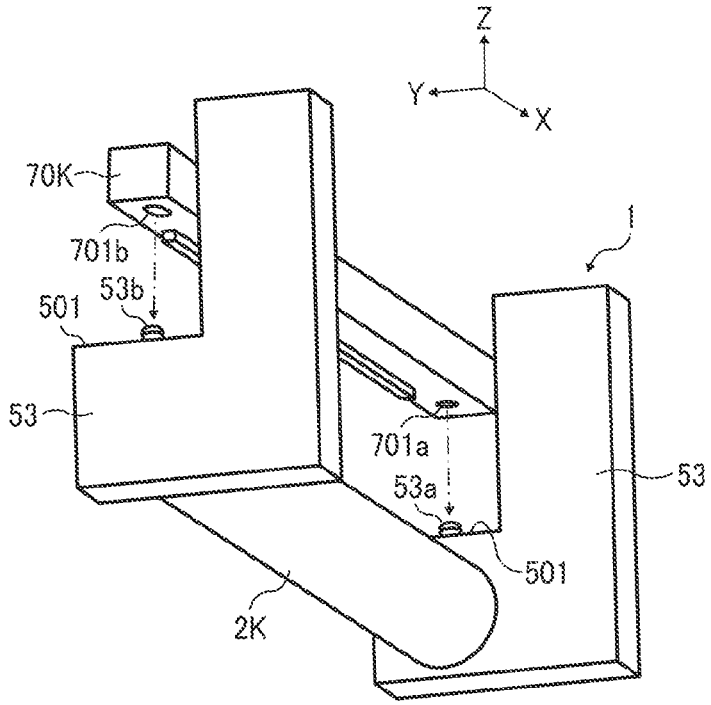
FIG. 6 is a perspective view illustrating a positioning structure of a recording head with respect to a photoreceptor.

FIG. 6 is a perspective view illustrating a positioning structure of a recording head 70K with respect to the photoreceptor 2K. Herein, a positioning structure of each recording head 70Y, 70M, or 70C with respect to each photoreceptor 2Y, 2M, or 2C is the same as that the recording head 70K.

As illustrated in FIG. 6, positioning projections 53*a*, 53*b* are disposed on a case 53 for the image forming unit 1K. Positioning recesses 701*a*, 701*b* are disposed on a surface of the recording head 70K opposed to the photoreceptor 2K at both lateral ends in the photoreceptor's longitudinal shaft direction, that is, in X direction in FIG. 6. The recess 701*a* at a distal side in FIG. 6 is a reference recess for positioning with a circular hole having substantially the same diameter as that of the positioning projection 53*a* or 53*b*. On the other hand, the recess 701*b* at a proximal side in FIG. 6 is a sub reference hole with a shape extending along the longitudinal shaft direction.

When the positioning projections 53*a*, 53*b* are inserted into the positioning recesses 701*a*, 701*b*, the recording head 70K is positioned with respect to the photoreceptor 2K in all directions of X, Y, and Z. The positioning projections 53*a*, 53*b* are disposed on a surface 501 of the case 53. When the surface of the recording head 70K opposed to the photoreceptor 2K contacts the surface 501 of the case 53, the recording head 70K is positioned in the Z- and Y-directions in the figure. Accordingly, the positional relation between the photoreceptor 2K and the recording head 70K is maintained highly precisely and an optimal latent image can be formed.

Figure 7:
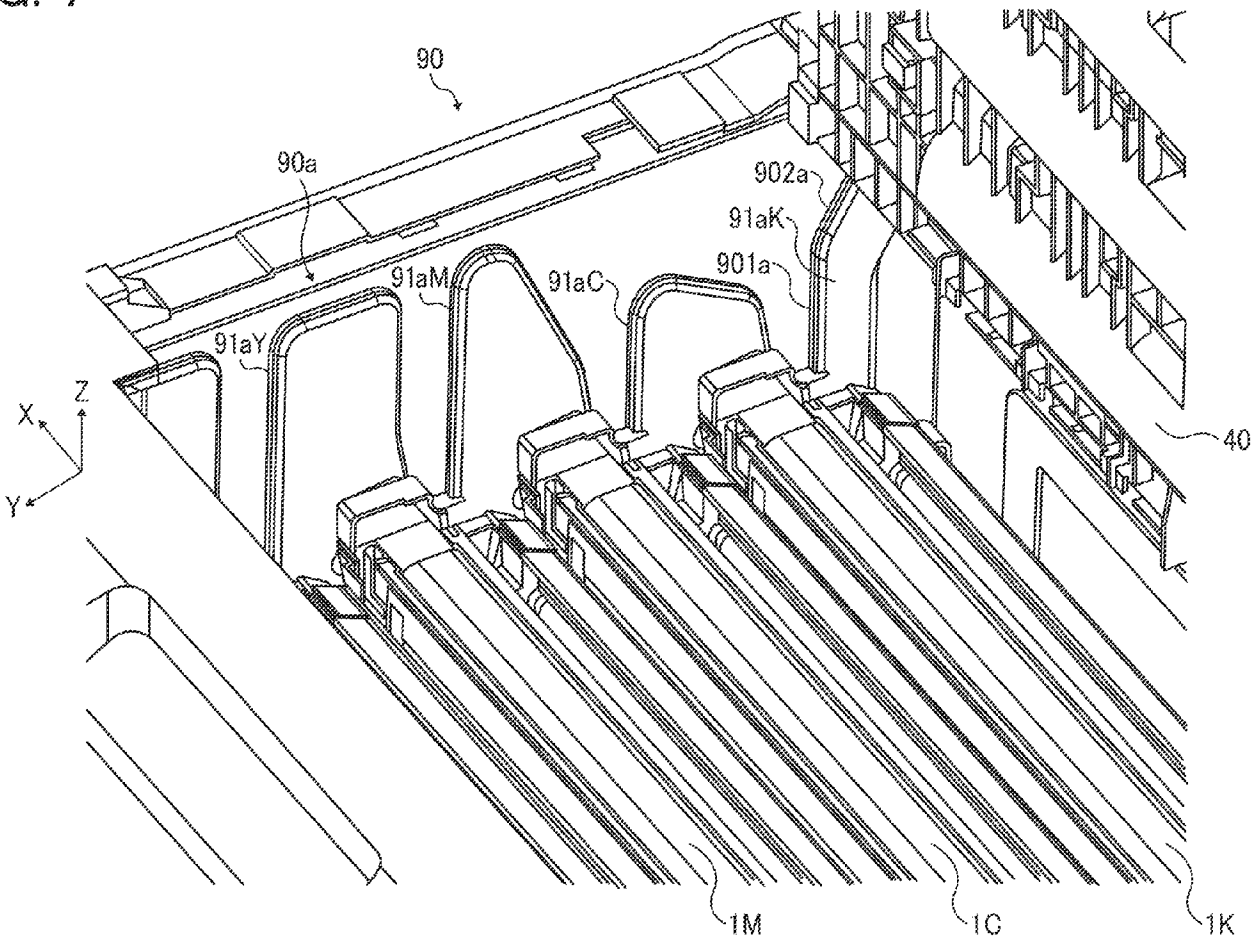
FIG. 7 is a perspective view illustrating a side plate of the housing disposed at one end of the recording head longitudinal direction.

FIG. 7 is a perspective view illustrating a side plate 90*a* disposed in the housing at one or a first longitudinal end of the recording head 70.

The housing 90 is formed of a metal plate and is provided with first guide members 91*a*Y, 91*a*M, 91*a*C, and 91*a*K at a side plate 90*a* disposed at one end of the housing 90 as illustrated in FIGS. 4, 5, and 7. The first guide members 91*a*Y, 91*a*M, 91*a*C, and 91*a*K each serve to introduce one longitudinal end of the recording head 70 in the housing 90. The first guide members 91*a*Y, 91*a*M, 91*a*C, and 91*a*K are formed such that a part of the side plate 90*a* is projected inwardly by a squeeze molding process. Thus, by integrally molding the first guide members 91*a*Y, 91*a*M, 91*a*C, and 91*a*K with the side plate 90*a*, the number of parts may be reduced compared to a case in which the first guide members 91*a*Y, 91*a*M, 91*a*C, and 91*a*K are formed separately from the side plate 90*a*, thereby reducing the overall cost of the apparatus. However, the guide members 91*a*Y, 91*a*M, 91*a*C, and 91*a*K can be formed separately from the side plate 90*a*. In such a case, the first guide members 91*a*Y, 91*a*M, 91*a*C, and 91*a*K can be fixed with a screw, for example. In this case, the guide members can be designed for the more flexible layout compared to the integral molding. The first guide members 91*a*Y, 91*a*M, 91*a*C, and 91*a*K extend sufficiently vertically above the image forming units 1Y, 1M, 1C, and 1K.

When the inner cover 40 is moved so that the recording heads 70Y, 70M, 70C, and 70K are moved between the retracted position and the image forming position, the arm members 76Y, 76M, and 76C and the first rotary members 72Y, 72M, 72C, and 72K each as a guided member protruding from the first arm member 101K contact the first guide members 91*a*Y, 91*a*M, 91*a*C, and 91*a*K, so that one longitudinal end of the recording heads 70Y, 70M, 70C, and 70K are guided by the first guide members 91*a*Y, 91*a*M, 91*a*C, and 91*a*K, respectively, and moves inside the housing 90.

Figure 8:
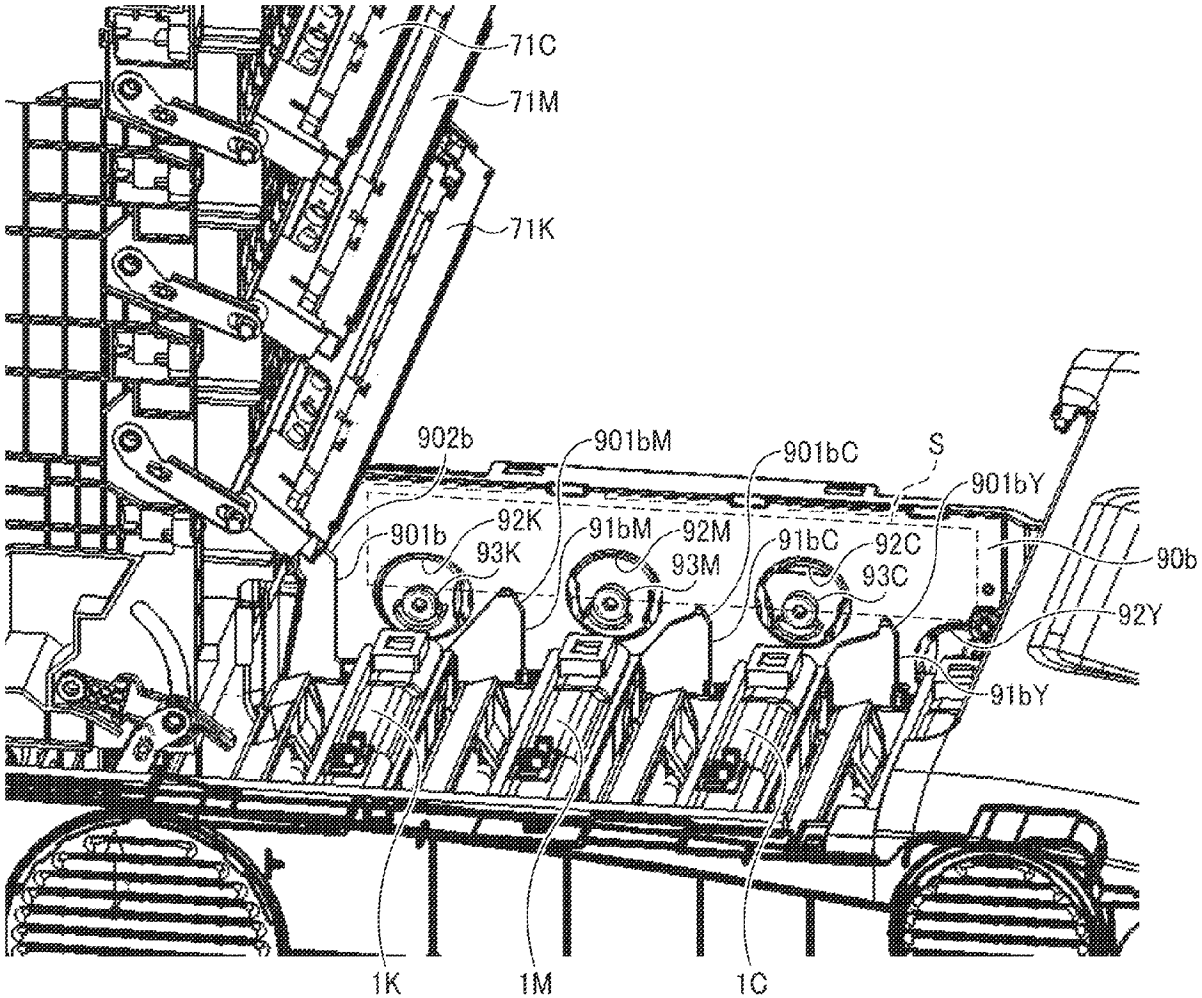
FIG. 8 is a perspective view illustrating a side plate of the housing disposed at the other end of the recording head longitudinal direction.

FIG. 8 is a perspective view illustrating a side plate 90*b* disposed in the housing at the other or the second longitudinal end of the recording head 70.

As illustrated in FIG. 8, a second side plate 90*b* of the housing 90 includes second guide members 91*b*Y, 91*b*M, 91*b*C, and 91*b*K to guide the other longitudinal end of the recording head 70 in the housing 90. However, the second guide members 91*b*Y, 91*b*M, 91*b*C, and 91*b*K are formed separately from the second side plate 90*b*, and are fixed by a screw and the like to the second side plate 90*b*. Thus, by forming the second guide members 91*b*Y, 91*b*M, 91*b*C, and 91*b*K separately from the second side plate 90*b*, the shape of the guide member may be designed with more flexibility compared to the case of the integral molding. The second guide members 91*b*Y, 91*b*M, 91*b*C, and 91*b*K are formed such that a part of the second side plate 90*b* is projected inwardly by a squeeze molding process similarly to the case of the first guide plate 90*a*. Thus, by integrally molding the second guide members 91*b*Y, 91*b*M, 91*b*C, and 91*b*K with the second side plate 90*b*, the number of parts may be reduced, thereby reducing the overall cost of the apparatus.

The second guide members 91*b*Y, 91*b*M, and 91*b*C are each shorter than the first guide members 91*a*Y, 91*a*M, and 91*a*C, so that a space S circled by a dashed line in the figure exists above the second side plate 90*b*. As illustrated in FIGS. 4 and 5, the drive transmission units 80Y, 80M, 80C, and 80K to transmit driving force to the toner bottles disposed in the inner cover 40 are provided in the space S. Thus, by shortening the second guide members 91*b*Y, 91*b*M, and 91*b*C, the drive transmission units 80Y, 80M, 80C, and 80K can be disposed in the space S above the second guide members 91*b*Y, 91*b*M, and 91*b*C, so that the compact apparatus can be obtained compared to the apparatus in which the second guide members 91*b*Y, 91*b*M, and 91*b*C are as long as the first guide members 91*a*Y, 91*a*M, and 91*a*C.

In addition, the second side plate 90*b* includes four through-holes 92Y, 92M, 92C, and 92K, from which gears 93Y, 93M, 93C, and 93K are protruded, respectively. When the inner cover 40 is closed, gears for the drive transmission units 80Y, 80M, 80C, and 80K engage with the gears 93Y, 93M, 93C, and 93K for the apparatus, respectively. Accordingly, the driving force of the drive motor disposed on the apparatus is transmitted to the toner bottles included in the inner cover 40 via the gears for the apparatus and the drive transmission units 80Y, 80M, 80C, and 80K.

When the inner cover 40 is moved so that each recording head 70Y, 70M, 70C, or 70K is moved between the retracted position and the latent image forming position, the first rotary member 72Y, 72M, 72C, and 72K, each as a guided part, protruding from the second arm members 76Y, 76M, and 76C and from the first arm member 101K contact the second guide members 91*b*Y, 91*b*M, 91*b*C, and 91*b*K, so that the other longitudinal end of each recording head 70Y, 70M, 70C, or 70K is guided by the other end or second guide members 91*a*Y, 91*a*M, 91*a*C, and 91*a*K.

The first guide members 91*a*Y, 91*a*M, and 91*a*C and the second guide members 91*b*Y, 91*b*M, and 91*b*C each include a vertically linear shape (i.e., in the Z-direction in the figure) relative to the image forming units 1Y, 1M, and 1C. With this structure, the recording head 70Y, 70M, or 70C can vertically linearly move in the housing 90 (i.e., in the Z-direction), and the positioning recesses 701*a*, 701*b* of the recording heads 70Y, 70M, and 70C can be inserted into the positioning projections 53*a*, 53*b* of the image forming units 1Y, 1M, and 1C, smoothly.

In addition, as illustrated in FIG. 8, a slanted portion 901*b*Y, 901*b*M, or 901*b*C slanted toward the rotary supporting point or the shaft 51 of the inner cover 40 is disposed on each second guide member 91*b*Y, 91*b*M, or 91*b*C, respectively.

The K-color first and second guide members 91*a*K, 91*b*K each includes a vertical linear portion 901*a*, 901*b* and a slanted portion 902*a*, 902*b* slanted toward the shaft 51. With this structure, the recording head 70K is first guided linearly in the vertical direction (i.e., along the Z-direction in the figure) via the linear portion 901*a*, 901*b* and then guided by the slanted portion 902*a*, 902*b*, to move to the shaft 51. Even in this case, the recording head 70K moves vertically and linearly in the housing 90 close to the latent image forming position. Accordingly, the positioning recesses 701*a*, 701*b* of the recording head 70K can be inserted smoothly into the positioning projections 53*a*, 53*b* of the image forming unit 1K.

When the recording heads 70Y, 70M, 70C, and 70K are each positioned at the latent image forming position, the arm members 76Y, 76M, and 76C and the first arm member 101K are pressed against the guide members 91Y, 91M, 91C, and 91K, respectively, through the torsion springs 78Y, 78M, 78C, and 103K. Then, the first rotary members 72Y, 72M, 72C, and 72K are pressed against the guide members 91Y, 91M, 91C, and 91K, respectively.

Next, moving of the recording head 70Y, 70M, 70C, and 70K will now be described with reference to FIGS. 9 and 10.

Figure 9:
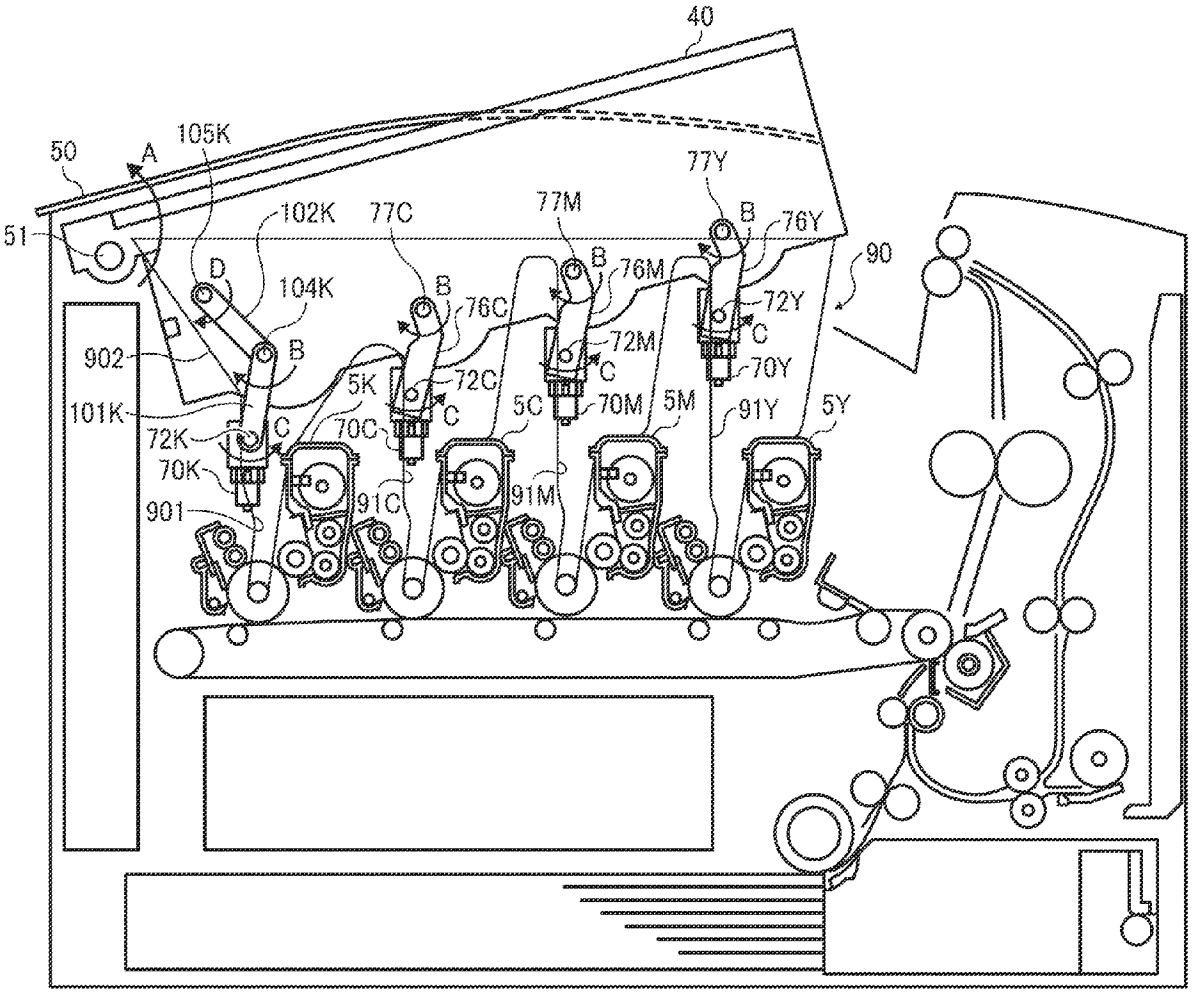
FIG. 9 is a view illustrating a state in which the inner cover starts opening.

FIG. 9 shows a state in which the inner cover 40 is beginning to open by 15 degrees. FIG. 10 shows a state in which the inner cover 40 is opened by 90 degrees.

After the upper cover 50 is opened from a state illustrated in FIG. 1, the inner cover 40 is opened gradually. Then, each recording head 70Y, 70M, 70C, or 70K first positioned at the latent image forming position moves to the retracted position via the inner cover 40.

First, moving of the Y-, M-, and C-color recording heads 70Y, 70M, and 70C will be described.

The second rotary members 77Y, 77M, and 77C fixed to the inner cover 40 moves along an arc-shaped locus about the shaft 51 being a rotary supporting point of the inner cover 40. Accordingly, until the second rotary members 77Y, 77M, and 77C reach the same height as that of the shaft 51, the second rotary members 77Y, 77M, and 77C move rightward as well in the figure. As a result, when the recording heads 70Y, 70M, and 70C move in the housing 90, the second rotary members 77Y, 77M, and 77C move rightward as well. On the other hand, the arm members 76Y, 76M, and 76C are rotatably supported relative to the second rotary members 77Y, 77M, and 77C, respectively, and are pressed against the guide members 91Y, 91M, and 91C by the torsion spring 78Y, 78M, and 78C, respectively (see FIG. 3). Therefore, when the second rotary members 77Y, 77M, and 77C move rightward in FIG. 9, the arm members 76Y, 76M, and 76C move in an arrow B direction. As a result, the first rotary members 72Y, 72M, and 72C linearly move while guided by the guide members 91Y, 91M, and 91C that extend linearly vertically. In addition, the first rotary members 72Y, 72M, and 72C are rotatably disposed relative to the arm members 76Y, 76C, and 76M, respectively. Accordingly, when the arm members 76Y, 76M, and 76C move in the arrow B direction in the housing, the recording heads 70Y, 70M, and 70C move in arrow C direction, whereby each surface of the recording heads 70Y, 70M, and 70C opposed to the photoreceptor becomes perpendicular to the vertical direction. As a result, when the recording heads 70Y, 70M, and 70C move to the retracted position from the latent image forming position, the positioning projections 53*a*, 53*b* as illustrated in FIG. 6, can be pulled smoothly from the positioning recesses 701*a*, 701*b*. In addition, because the recording heads 70Y, 70M, and 70C can move linearly vertically (in Z-direction in the figure), even though the developing device 5K is disposed in the vicinity of the recording heads 70Y, 70M, and 70C, the developing device 5K is prevented from striking the developing devices 5Y, 5M, and 5C when the recording heads 70Y, 70M, and 70C are moving. With this configuration, the apparatus can be formed into a compact shape.

In addition, when the arm members 76Y, 76M, and 76C are pressed against the guide members 91Y, 91M, and 91C via the torsion springs 78Y, 78M, and 78C, respectively, the first rotary members 72Y, 72M, and 72C are pressed against the guide members 91Y, 91M, and 91C. With this structure, vibration of the arm members 76Y, 76M, and 76C inside the housing may be prevented even when the inner cover 40 is subjected to an unexpected vibration or impact. As a result, damage to the recording head 70Y, 70M, or 70C due to collision of the parts in the housing can be prevented.

Further, when the inner cover 40 is further rotated and the first rotary members 72Y, 72M, and 72C are separated from the guide members 91Y, 91M, and 91C, the arm members 76Y, 76M, and 76C abut a regulating part, not shown, so as to prevent the arm members 76Y, 76M, and 76C from moving in the arrow B direction. With this structure, after the first rotary members 72Y, 72M, and 72C have been separated from the guide members 91Y, 91M, and 91C, the arm members 76Y, 76M, and 76C are pressed against the regulating part, not shown, by the pressing force of the torsion springs 78Y, 78M, and 78C. As a result, the arm members 76Y, 76M, and 76C can be prevented from moving due to vibration or impact even after the first rotary members 72Y, 72M, and 72C have been separated from the guide members 91Y, 91M, and 91C. Accordingly, damage to the recording heads 70Y, 70M, and 70C due to collision against the bottom of the inner cover 40 may be prevented. Further, when the recording heads 70Y, 70M, and 70C each are moved from the retracted position to the latent image forming position, the first rotary members 72Y, 72M, and 72C can be prevented from vibrating, whereby the first rotary members 72Y, 72M, and 72C can securely contact the guide members 91Y, 91M, and 91C, respectively.

The first rotary members 72Y, 72M, and 72C are separated from the guide members 91Y, 91M, and 91C, the arm members 76Y, 76M, and 76C abut against the regulating part, not shown, and are prevented from moving toward the arrow B direction. Then, the recording heads 70Y, 70M, and 70C move in the opposite direction different from the arrow C direction in FIG. 9 according to the move of the inner cover 40 to an open position. Then, a relation that the surface of the recording heads 70Y, 70M, and 70C opposite the photoreceptor is perpendicular to the vertical Z-direction is maintained. As a result, as illustrated in FIG. 10, even when the recording heads 70Y, 70M, and 70C are in the retracted position, the surface of the recording heads 70Y, 70M, and 70C opposite the photoreceptor is directed below in the vertical direction, so that contamination of a lens may be prevented, in the replacement of the image forming units 1Y, 1M, 1C, and 1K, due to contact to the lens disposed on each surface of the recording heads 70Y, 70M, and 70C opposite the photoreceptor.

When the inner cover 40 is moved from the open position to the closed position and the recording heads 70Y, 70M, and 70C are moved from the retracted position to the latent image forming position, the arm members 76Y, 76M, and 76C are pressed against the not-shown regulating part and each of the first rotary members 72Y, 72M, and 72C moves keeping a posture contacting each of the guide members 91Y, 91M, and 91C. Accordingly, the first rotary members 72Y, 72M, and 72C each contact the guide members 91Y, 91M, and 91C securely. From a state in which the first rotary members 72Y, 72M, and 72C contact the guide members 91Y, 91M, and 91C, respectively, if the inner cover 40 is gradually closed, the first rotary members 72Y, 72M, and 72C are pushed into the guide members 91Y, 91M, and 91C. Then, the arm members 76Y, 76M, and 76C move in the direction opposite the arrow B direction of FIG. 9, by the reaction force of the guide members 91Y, 91M, and 91C against the pressing force of the torsion springs 78Y, 78M, and 78C, the first rotary members 72Y, 72M, and 72C move linearly and vertically guided by the guide members 91Y, 91M, and 91C. With this structure, the recording heads 70Y, 70M, and 70C can linearly move directly below in the housing 90, and the positioning projections 53*a*, 53*b* can be engaged with the positioning recesses 701*a*, 701*b* as illustrated in FIG. 6.

Next, moving of the K-color recording head 70K will be described.

When the recording head 70K is in the latent image forming position, the first arm member 101K is pressed to rotate in the arrow B direction via the torsion spring 103K (see FIG. 3). Therefore, if the recording head 70K is at the latent image forming position, the first rotary member 72K strikes a straight portion 901 of the guide member 91K and the second rotary member 104K strikes the opposite end of the shaft 51 of the guide recess 42K (see FIG. 3).

When the inner cover 40 is moved from the closed position to the open position and the K-color recording head 70K is moved from the latent image forming position to the retracted position, the third rotary member 105K fixed on the inner cover 40 moves along the arc-shaped locus about the shaft 51 being the rotary supporting point of the inner cover 40. As a result, while the recording head 70K is moving in the housing, the third rotary member 105K moves rightward as well in the figure. When the third rotary member 105K moves rightward in the figure, the first arm member 101K moves in the arrow B direction by the pressing force of the torsion spring 103K. As a result, the first rotary member 72K disposed at a bottom end of the first arm member 101K is pressed against the straight portion 901 extending vertically linearly from the guide member 91K, and the first rotary member 72K moves guided by the straight portion 901. In addition, the second rotary member 104K disposed at an upper end of the first arm member 101K is pressed toward opposite the shaft 51 by the pressing force of the torsion spring 103K, so that the second rotary member 104K is maintained to be contacted an opposite end of the shaft 51 of the guide recess 42K. With this structure, when vibration or impact is given to the inner cover 40 when the recording head 70K is moving, the first arm member 101K can be prevented from vibrating in the housing. As a result, damage to the recording head 70K due to collision of the parts in the housing can be prevented.

In addition, the first rotary member 72K is rotatably disposed with respect to the first arm member 101K. Accordingly, when the arm members 101K rotates in the arrow B direction in the housing, the recording head 70K moves in the arrow C direction and a relation in which the surface of the recording head 70K opposite the photoreceptor is perpendicular to the vertical direction is maintained. As a result, when the recording head 70K moves from the latent image forming position to the retracted position, the positioning projections 53*a* and 53*b*, as illustrated in FIG. 6, are pulled smoothly from the positioning recesses 701*a*, 701*b*. In addition, because the recording heads 70K can move linearly vertically in the housing 90, even though the developing device 5K is disposed in the vicinity of the recording head 70K, the recording head 70K while moving does not strikes the developing device 5K. With this configuration, the apparatus can be formed in a compact.

Further, when the inner cover 40 is further rotated and the first rotary member 72K is guided to around the upper end of the straight portion 901 of the guide member 91K (that is, a joint portion between the straight portion 901 and the slanted portion 902), the first arm member 101K abuts the not-shown regulating part, and is prevented from moving in the arrow B direction. From this state, if the inner cover 40 is further opened, the second rotary member 104K causes the guide recess 42K to move toward the shaft 51 due to the own weight of the recording head 70K and the like. With this structure, the second arm member 102K moves to the arrow D direction about the third rotary member 105K and further moves being guided by the straight portion 901 of the guide member 91.

As to the K-color related structure, the third rotary member 105K fixed to the inner cover 40 moves along an arc-shaped locus about the shaft 51 being a rotary supporting point of the inner cover 40. Because the third rotary member 105K is close to the shaft 51, rightward moving amount of the third rotary member 105K when the K-color recording head 70K moves in the housing is greater than that of the Y-, M-, and C-color second rotary members 77Y, 77M, and 77C.

If, hypothetically, the K-color armature is configured similarly to the Y-, M-, and C-color armatures, and that the moving area of the recording head 70K relative to the inner cover 40 is similar to the moving area of the Y-, M-, and C-color recording heads 70Y, 70M, and 70C, the arm-shaped member contacts the not-shown regulating part before the K-color recording head 70K gets out of the housing 90. As a result, K-color recording head 70K moves rightward in the housing and cannot be moved linearly in the vertical direction in the housing. As a result, the K-color developing device 5K needs to be disposed separately from the recording head 70K, and the apparatus cannot be made into a compact.

On the other hand, in the present embodiment, because the second arm member 102K moves in the arrow D direction after the first arm member 101K is regulated by the not-shown regulating part. Thus, the recording head 70K can be moved leftward relative to the inner cover 40. Accordingly, even after the first arm member 101K has been regulated by the not-shown regulating part, the recording head 70K can be moved by being guided by the straight portion 901 of the guide member 91 and can be moved linearly upward in the vertical direction in the housing. As a result, the K-color developing device 5K need not be disposed away from the recording head 70K, so that the apparatus can be made into a compact.

When the inner cover 40 is further opened, the second arm member 102K moves toward the arrow D direction about the third rotary member 105K and the first rotary member 72K is guided from the straight portion 901 to the slanted portion 902 of the guide member 91, and the recording head 70K moves toward the shaft 51.

When the inner cover 40 is moved in arrow A direction to be open, the slanted angle of the guide recess 42K increases. If the guide member 91K includes only the straight portion 901 and does not include the slanted portion 902, when the first rotary member 72K is away from the straight portion 901, the second arm member 102K rotates swiftly in the arrow D direction due to its own weight, and the second rotary member 104K strikes the end portion of the shaft 51 of the guide recess 42K, which may damage the second rotary member 104K, for example. On the other hand, by providing the slanted portion 902 as in the present embodiment, because the second arm member 102K is prevented from moving swiftly toward the allow D direction due to its own weight, the recording head 70K can be moved to the shaft 51 gradually in accordance with the opening operation of the inner cover 40. With this configuration, damage to the second rotary member 104K can be prevented.

When the inner cover 40 is moved to the open position, the second rotary member 104K abuts against the end portion of the shaft 51 of the guide recess 42K, so that the oscillation of the second arm member 102K toward the arrow D direction is prevented.

Thus, in the present embodiment, the K-color armature 170K includes the first arm member 101K to hold the recording head 70K via the head holder 71K and the second arm member 102K rotatably supported by the inner cover 40 and rotatably supporting the first arm member 101K. When the recording head 70K is moved from the latent image forming position, the first arm member 101K can be movable relative to the second arm member 102K, so that the recording head 70K can be moved in a linear mode. Then, after the recording head 70K has been moved linearly to some extent, the second arm member 102K is moved about the third rotary member 105K in the arrow D direction, so that the recording head 70K can be retracted toward the shaft 51.

Figure 10:
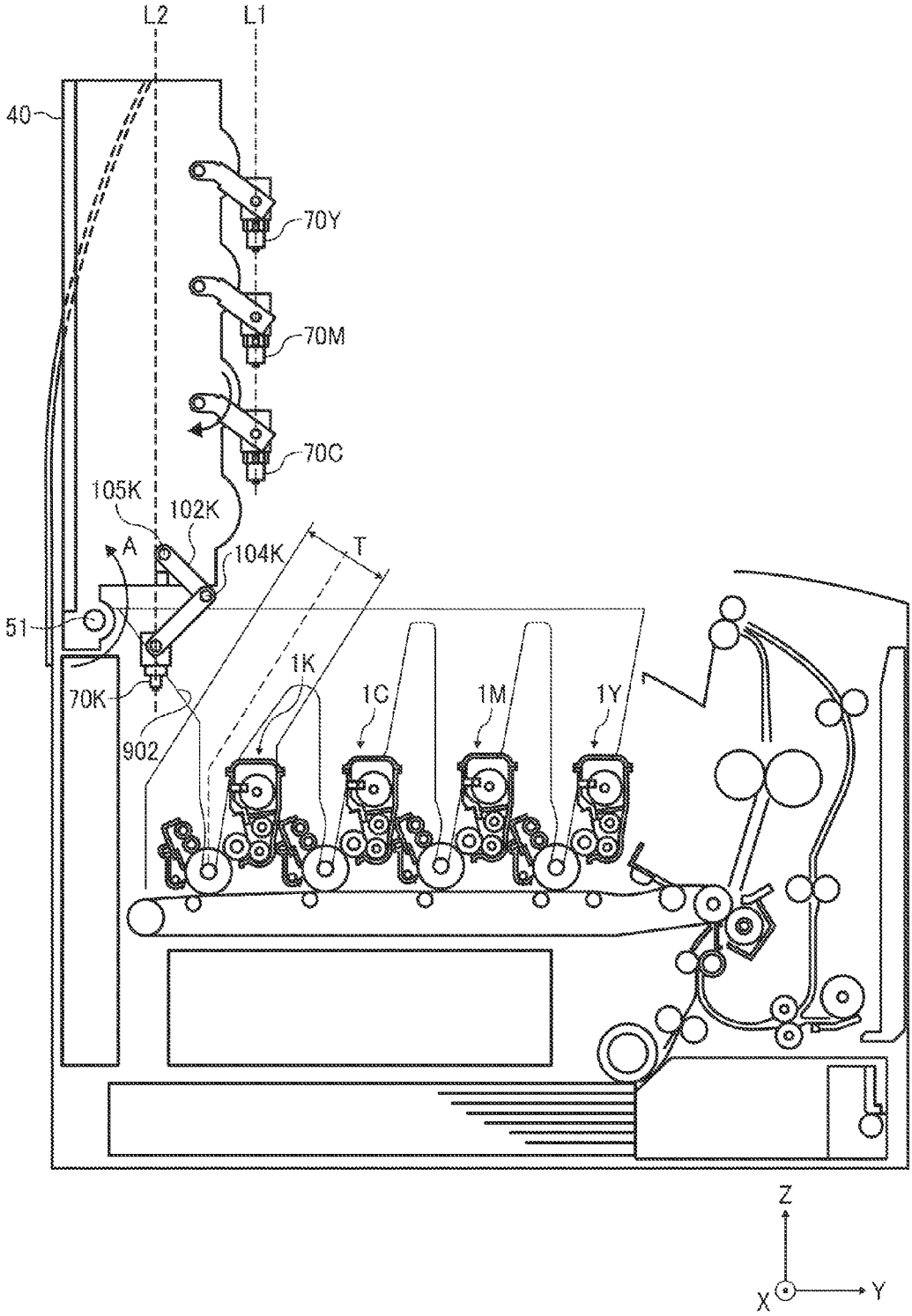
FIG. 10 is a view illustrating a state in which the inner cover is rotated by 90 degrees.

As illustrated in FIG. 10, when each recording head 70Y, 70M, 70C, or 70K is positioned at the retracted position by opening the inner cover 40 by 90 degrees, the K-color recording head 70K positioned nearest to the shaft 51 which is a rotary supporting point of the inner cover 40 is positioned closer to one end of the housing 90 (i.e., at the side of the shaft 51) than the Y-, M-, or C-color recording head 70Y, 70M, or 70C. Accordingly, even when the inner cover 40 cannot be open more than 90 degrees because of the presence of a wall on the left of the shaft 51 of the printer or the presence of any tall member placed on the left, the K-color recording head 70K can be positioned at a retracted position from the moving area T when the K-color image forming unit 1K is pulled out. As a result, when the inner cover 40 is opened to rotate by 90 degrees to take out the K-color image forming unit 1K from the housing 90, the K-color recording head 70K does not disturb the operation and the K-color recording head 70K can be taken out easily from the housing 90. As a result, damage to the recording head 70K due to the collision of parts in the housing can be prevented. In addition, when the K-color image forming unit 1K is replaced, because the recording head 70K does not abut against the image forming unit 1K, damage to the recording head 70K can be prevented.

Further, when the inner cover 40 is opened by 90 degrees, the recording head 70K is positioned closer to the one end at the shaft 51 of the housing 90 than the third rotary member 105K being the rotary supporting point of the second arm member 102K. As a result, the image forming unit 1K is retracted from the area T where the image forming unit 1K passes through when the image forming unit 1K is taken out from the housing 90. Accordingly, the recording head 70K is more securely prevented from striking the image forming unit 1K when the K-color image forming unit 1K is replaced.

In addition, when the recording head 70K is positioned at the retracted position, the second rotary member 104K contacts the end of the guide recess 42K of the side of the shaft 51 and the first rotary member 72K is in contact with the slanted portion 902. With this structure, when the recording head 70K is positioned at the retracted position, the second arm member 102K is prevented from oscillating in the clockwise direction as in FIG. 9. Accordingly, even though the apparatus is subjected to vibration or impact, the recording head 70K is prevented from further moving to the shaft 51. Then, damage to the recording head 70K due to collision with the shaft 51 can be prevented.

Due to the layout of the apparatus, the recording head 70C, second closest to the shaft 51, may be in the moving range T of the K-color image forming unit 1K when removing same from the housing. In this case, the recording head 70C, second closest to the shaft 51 can be retracted, similarly to the K-color recording head, closer to one end of the housing 90 toward the shaft 51 than the Y- and M-color recording heads 70Y, 70M.

When the inner cover 40 is moved from the open position to the closed position and the recording head 70K is moved from the retracted position to the latent image forming position, the first rotary member 72K is guided by the slanted portion 902 and the recording head 70K is moved to a separating direction from the shaft 51. When the inner cover 40 is further closed, the first rotary member 72K is separated from the slanted portion 902 of the guide member 91K immediately before the third rotary member 105K has reached the same level of the shaft 51. When the inner cover 40 is further closed, the height of the third rotary member 105K becomes below the height of the shaft 51, and the lateral movement of the third rotary member 105K is switched from the receding movement from the shaft 51 to the approaching movement thereto, the first rotary member 72K abuts the straight portion 901 of the guide member 91K. When the inner cover 40 is further closed from the above state, the first rotary member 72K is pushed by the straight portion 901 of the guide member 91K. Then, the second rotary member 104K moves to recede from the shaft 51 in the guide recess 42K, the second arm member 102K moves in the direction opposite the arrow D direction in FIG. 8, and the first rotary member 72K moves vertically and linearly while being guided by the straight portion 901 of the guide member 91K. When the inner cover 40 is further closed, the second rotary member 104K abuts against the end opposite the shaft 51 side end of the guide recess 42K. When the inner cover 40 is further closed from the above state, the first arm member 101K swings in the direction opposite the arrow B direction in FIG. 9 against the pressing force of the torsion spring 103K. As a result, the first rotary member 72K moves vertically linearly while being guided by the straight portion 901 of the guide member 91K. With this structure, the recording head 70 moves vertically downward in the housing and the positioning projections 53*a*, 53*b* can be engaged with the positioning recesses 701*a*, 701*b*, respectively, as illustrated in FIG. 6.

In the present embodiment, the guide recess 42K is provided and the second rotary member 104K is caused to abut the end of the guide recess 42K, so that the moving range of the second arm member 102K is regulated. Alternatively, the regulating projection is provided to the inner cover 40 and the second arm member 102K is caused to abut the regulating projection, so that the moving range of the second arm member 102K can be regulated.

Figure 11:
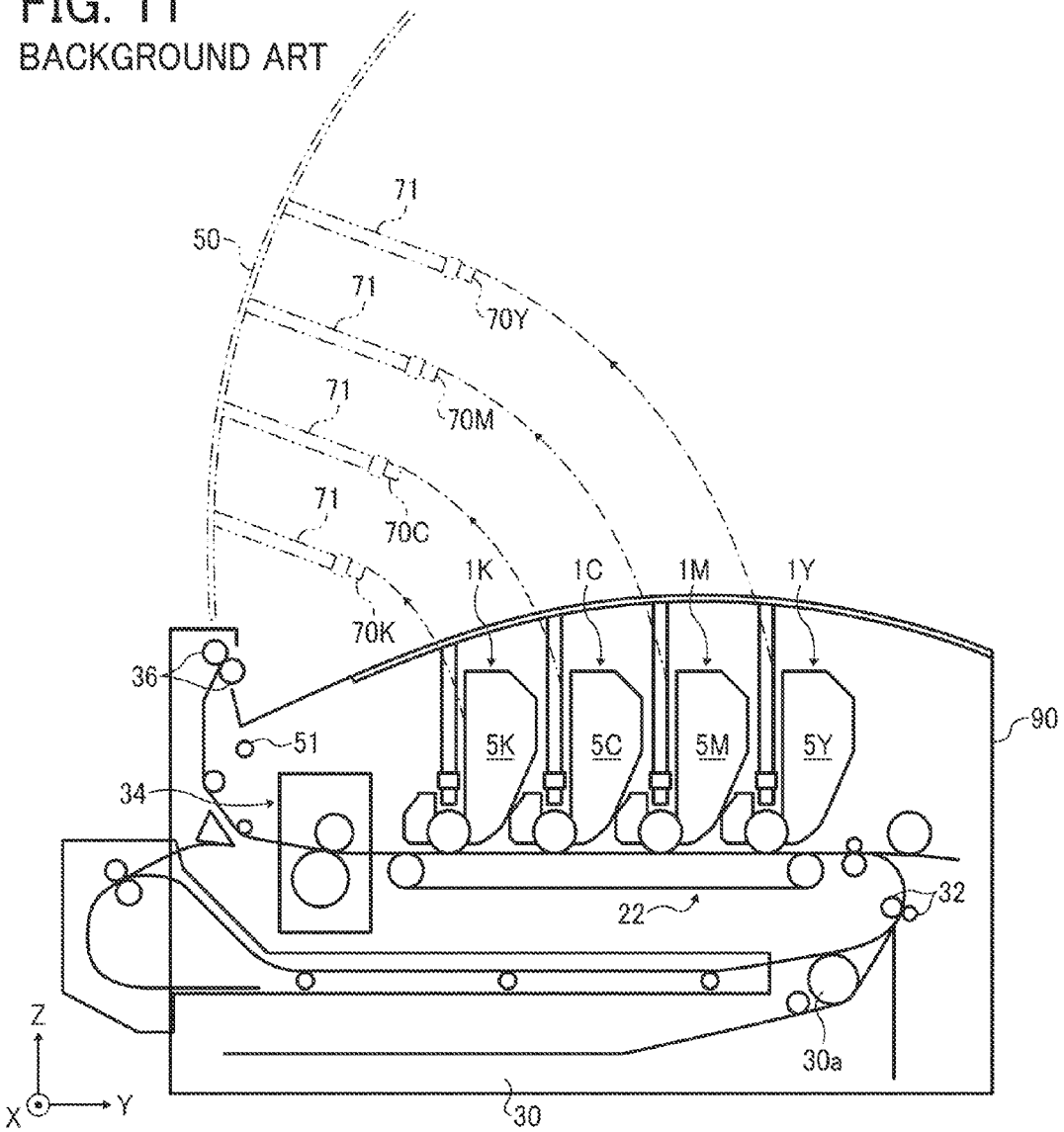
FIG. 11 BACKGROUND ART
FIG. 11 is a schematic view of a conventional image forming apparatus.

FIG. 11 is a schematic structure of a conventional image forming apparatus.

As illustrated in FIG. 11, if the rotary supporting point of the upper cover 50 as a supporter of the recording head 70 is disposed at a position sufficiently removed from the image forming units 1Y, 1M, 1C, and 1K, a radius of the arc-shaped moving locus of each recording head 70Y, 70M, 70C, or 70K becomes greater when the upper cover 50 is closed. As a result, moving amount of each recording head 70Y, 70M, 70C, or 70K in the housing 90 in the lateral direction in FIG. 11 can be reduced. Accordingly, even when each recording head 70Y, 70M, 70C, or 70K is held non-swingably in the upper cover 50, each recording head 70Y, 70M, 70C, or 70K does not strike on a developer unit 5 and the like, and can be set in the apparatus housing.

On the other hand, as illustrated in FIG. 1, when the rotary supporting point of the inner cover 40 as a supporter to support the recording head 70 is disposed at an end opposite the recording sheet P conveyance portion (right in the figure) and the distance between the each recording head 70Y, 70M, 70C, or 70K and the supporting point is shorter than the conventional structure as illustrated in FIG. 11, the lateral moving amount of each recording head 70Y, 70M, 70C, or 70K in the housing becomes greater. As a result, similarly to the conventional image forming apparatus as illustrating in FIG. 11, if each recording head 70Y, 70M, 70C, or 70K is non-swingably fixed in the inner cover 40, the recording head 70Y, 70M, 70C, or 70K tends to abut the developer unit 5, for example.

By contrast, in the present embodiment, each recording head 70Y, 70M, 70C, or 70K is swingably held relative to the inner cover 40, so that each recording head 70Y, 70M, 70C, or 70K is positioned closer to the inner cover 40 in the retracted position than in the latent image forming position. Accordingly, each recording head can be moved above the developer unit 5 in the housing, whereby each recording head is prevented from striking the developer unit.

However, when each recording head 70 is configured to move above the developer unit 5 in the housing, each recording head 70 is not positioned at the latent image forming position in the vicinity of the photoreceptor when the inner cover 40 is closed. As a result, in the present embodiment, the first rotary member 72 as a guided portion of the recording head 70 moving above the developer unit is contacted with the guide member and the recording head 70 is guided to the latent image forming position by the guide member.

In order that the first rotary member 70 as a guided portion of the recording head 70 moving above the developer unit is allowed to contact the guide member, the guide member needs to be extended to a position crossing the arc-shaped moving locus of the recording head rotating about the rotation center of the inner cover 40. Accordingly, the guide member needs to be extended sufficiently upward from the image forming unit. However, if the guide member is thus extended upward sufficiently from the image forming unit, the space for providing the guide member needs to be secured. Therefore, because the drive transmission unit to transmit a driving force of the motor to the toner bottle cannot be disposed in the limited space, the entire apparatus tends to be bigger.

Accordingly, in the present embodiment, the first guide members 91*a*Y, 91*a*M, and 91*a*C are disposed vertically above enough the image forming unit and the second guide members 91*b*Y, 91*b*M, and 91*b*C are made shorter than the first guide members 91*a*Y, 91*a*M, and 91*a*C, so that the second guide members 91*b*Y, 91*b*M, and 91*b*C allow the recording heads 70Y, 70M, and 70C that have come close to the latent image forming position to be guided to the latent image forming position.

Figure 12:
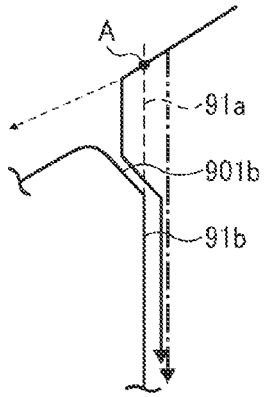
FIG. 12 is a schematic view illustrating a moving locus of a first rotary member disposed at the other end when the inner cover is being closed.

FIG. 12 is a schematic view illustrating a moving locus of the first rotary member disposed at the other or second end when the inner cover is closed. In the explanation below, a member disposed at one end or the first end is given a suffix "a" and a member disposed at the other end or the second end is given a suffix "b". If the explanation is given without any discrimination, the suffixes "a" and "b" will be omitted.

A dashed-dotted line in FIG. 12 shows a moving locus of the first rotary member 72*a* at the first end in the recording head longitudinal direction, and a solid line in the figure shows a moving locus of the first rotary member 72*b* at the second end in the recording head longitudinal direction. In addition, suffixes representing different colors of Y, M, and C will be appropriately omitted in the explanation below.

When the inner cover is being closed, the first rotary member 72*a* at the first end and the first rotary member 72*b* at the second end both move along an arc-shaped moving locus about the rotary supporting point (or the shaft 51) of the inner cover 40. Because the guide member 91*a* at the first end extends to the position crossing the arc-shaped moving locus, the first rotary member 72*a* at the first end contacts the guide member 91*a* at the first end and moves downward being guided by the guide member 91*a* at the first end as shown by the dashed-dotted line in the figure.

On the other hand, the guide member 91*b* at the second end does not extend to the position to cross the arc-shaped moving locus. Then, the first rotary member 72*b* at the second end moves while drawing the arc-shaped moving locus. When from this state, the inner cover 40 is closed to some extent and the first rotary member 72*b* at the second end protrudes leftward in the figure by a certain degree (toward the rotary supporting point of the inner cover 40) relative to the first rotary member 72*a* at the first end due to the rigidity of the recording head 70 or the head holder 71 holding the recording head 70, the first rotary member 72*b* at the second end is prevented from the arc-shaped move as shown by the dashed line and moves downward as shown by the solid line in FIG. 12. When the inner cover 40 is further closed, the first rotary member 72*b* at the second end contacts the slanted portion 901*b*. When the inner cover 40 is further closed, the first rotary member 72*b* at the second end moves rightward while being guided by the slanted portion 901*b* and contacts the guide member 91*b* at the second end. With this configuration, the first rotary member 72*b* at the second end can be guided by the guide member 91*b* at the second end.

Thus, in the present embodiment, even though the guide member 91*b* at the second end does not extend to the position crossing the arc-shaped moving locus, the first rotary member 72*b* at the first end contacts the guide member 91*b* at the second end. With this configuration, even though the guide member 91*b* at the second end is short, the first rotary member 72*b* at the second end can contact the guide member 91*b* at the second end and the recording head at the second end can be guided precisely to the latent image forming position by the guide member 91*b* at the second end. In addition, because the recording head 70 can be passed through above enough the developer unit 5, even though the moving locus of the first rotary member 72 from the retracted position is away to some extent relative to the prescribed moving locus, there is no possibility that the recording head 70 strikes against the developer unit 5 and the first rotary member 72*a* at the first end can contact the guide member 91*a* at the first end.

As described above, even though the guide member 91*b* at the second end is shorter than the guide member 91*a* at the first end, the recording head 70 can be optimally guided to the latent image forming position and a space is secured above the guide member 91*b* at the second end. Accordingly, the drive transmission unit 80 can be disposed in the thus-obtained space, so that a compact apparatus can be provided.

When the first rotary member 72*b* at the second end is positioned at a point A in FIG. 12, the guide member 91*a* at the first end is applied with a pressing force of the torsion spring 78*a* of the armature 170*a* of the first end. In addition, at the point A, a torsion force is applied to the head holder 71 or the recording head 70, and the resilience of the head holder 71 and the recording head 70 are added. When the inner cover 40 is further closed from the above point A, the arm member 76*b* of the second end swings against the pressing force of the torsion spring 78*b* of the second end. As a result, the pressing force from the torsion spring 78*b* of the second end is added to the guide member 91*a* of the first end. As a result, the transfer resistance of the first rotary member 72*a* at the first end against the guide member 91*a* at the first end increases, thereby increasing the resistance when the inner cover 40 is closed.

To cope with this, the moving locus of the first rotary member 72*a* at the first end from the retracted position to the position to contact the guide member 91*a* at the first end is made different between the recording head longitudinal first end and the second end thereof.

Specifically, in the Y-, M-, and C-color armatures 170Y, 170M, and 170C, a regulated position of the arm member 76*a* of the first end in the recording head longitudinal direction (in the X-direction in the figure) and a regulated position of the arm member 76*b* of the second end are made different from each other. In the retracted position, the recording head of the first end is positioned closer to the inner cover 40 than the recording head at the second end is. With this structure, the recording head 70 and the head holder 71 to hold the recording head 70 are twisted and held slanted relative to the main scanning direction in the retracted position.

Figure 13:
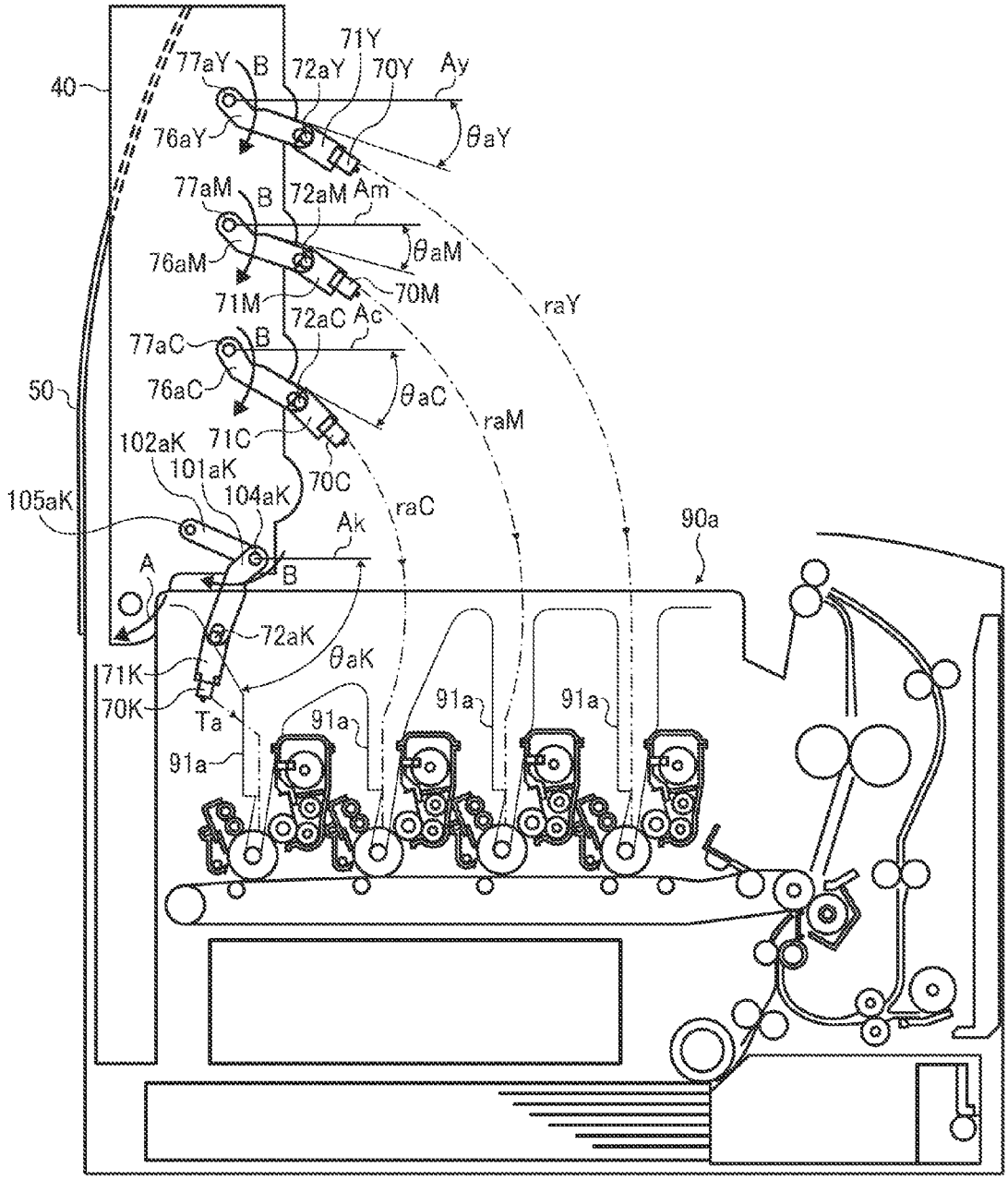
FIG. 13 is a schematic configuration illustrating the recording heads at one longitudinal end when the inner cover is opened.
Figure 14:
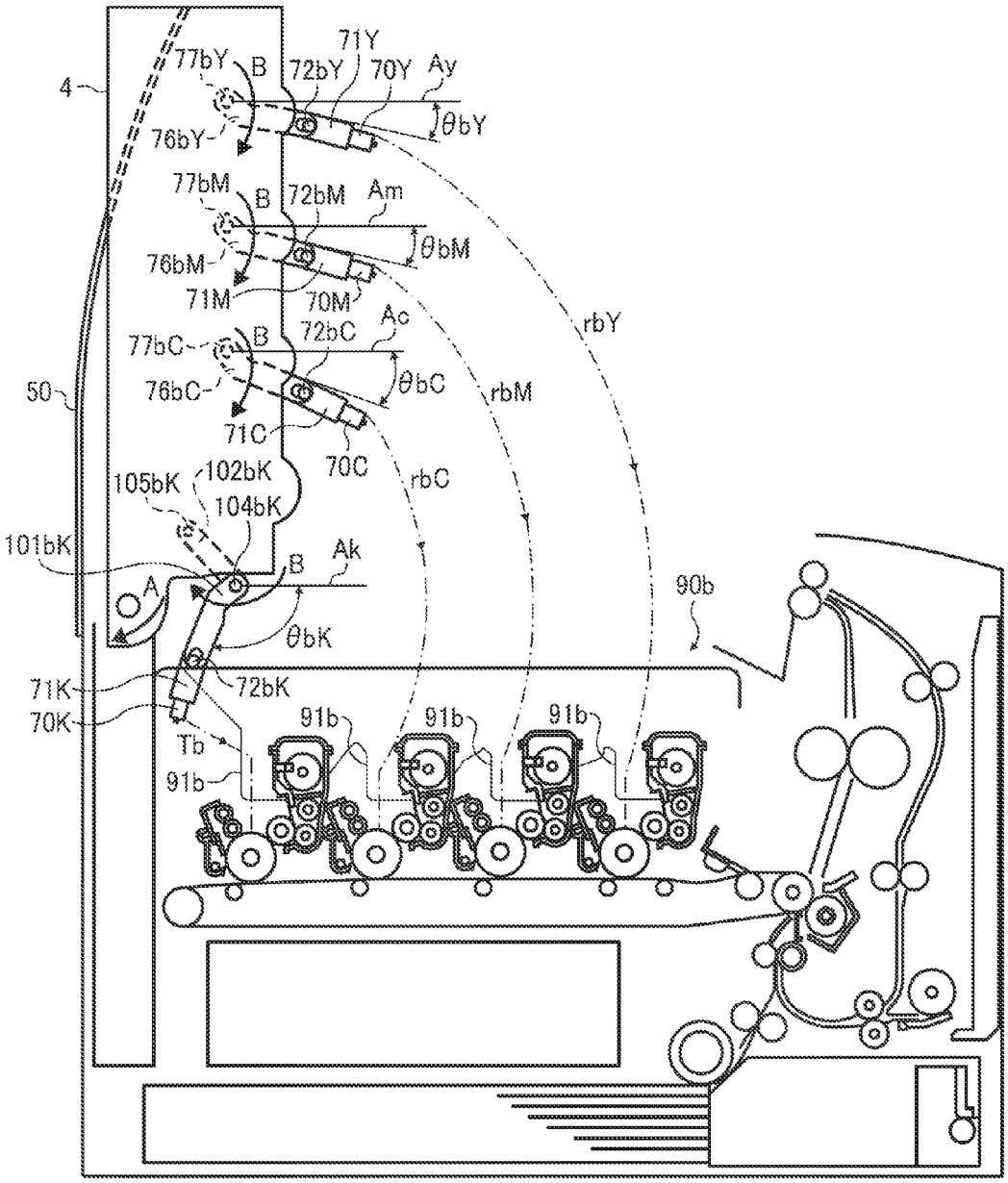
FIG. 14 is a schematic configuration illustrating the recording heads at the other longitudinal end when the inner cover is opened.

FIG. 13 is a schematic configuration illustrating the recording heads at the first longitudinal end when the inner cover 40 is opened; and FIG. 14 is a schematic configuration illustrating the recording heads at the second longitudinal end when the inner cover 40 is opened.

Lines Ay, Am, Ac, and Ak illustrated in FIGS. 13 and 14 are lines connecting the latent image forming position (when the inner cover 40 is in the latent image forming position) with each center of the second rotary member 77.

As illustrated in FIG. 13, when the Y-color recording head 70Y moves from the latent image forming position at the first end to the retracted position, the swing angle θaY related to the inner cover 40 is 20 degrees. The radius raY of the arc-shaped moving locus of the first rotary member 72*a*Y at the first end rotating about the shaft 51 from the retracted position up to a position contacting the guide member 91*a*Y at the first end is 279 mm. On the other hand, as illustrated in FIG. 14, when the Y-color recording head 70Y moves from the latent image forming position at the second end to the retracted position, the swing angle θbY related to the inner cover 40 is 10 degrees. The radius rbY of the arc-shaped moving locus of the first rotary member 72*b*Y at the second end rotating about the shaft 51 from the retracted position up to a position contacting the guide member 91*b*Y at the second end is 299 mm.

In addition, as illustrated in FIG. 13, when the M-color recording head 70M moves from the latent image forming position at one end to the retracted position, the swing angle θaM related to the inner cover 40 is 20 degrees. The radius raM of the arc-shaped moving locus of the first rotary member 72*a*M at the first end rotating about the shaft 51 from the retracted position up to a position contacting the guide member 91*a*M at the first end is 220 mm. On the other hand, as illustrated in FIG. 14, when the M-color recording head 70M moves from the latent image forming position at the other end to the retracted position, the swing angle θbM related to the inner cover 40 is 13 degrees. The radius rbM of the arc-shaped moving locus of the second rotary member 72*b*M at the second end rotating about the shaft 51 from the retracted position up to a position contacting the guide member 91*b*M at the second end is 223 mm.

In addition, as illustrated in FIG. 13, when the C-color recording head 70C moves from the latent image forming position at one end to the retracted position, the swing angle θaC related to the inner cover 40 is 30 degrees. The radius raC of the arc-shaped moving locus of the first rotary member 72*a*C at the first end rotating about the shaft 50 from the retracted position up to a position contacting the guide member 91*a*C at the first end is 155 mm. On the other hand, as illustrated in FIG. 14, when the C-color recording head 70C moves from the latent image forming position at the other end to the retracted position, the swing angle θbC related to the inner cover 40 is 22 degrees. The radius rbC of the arc-shaped moving locus of the second rotary member 72*b*C at the second end rotating about the shaft 51 from the retracted position up to a position contacting the guide member 91*b*C at the second end is 171 mm.

In addition, as illustrated in FIG. 13, when the K-color recording head 70K moves from the latent image forming position at one end to the retracted position, the swing angle θaK related to the inner cover 40 is 112 degrees. As illustrated in FIG. 14, the swing angle θbK of the K-color recording head 70K, moving from the latent image forming position at the second end to the retracted position, related to the inner cover 40 is 115 degrees. In the present embodiment, the swing angle of the K-color recording head related to the inner cover 40 is made different at the first end and the second end. However, as to the K-color structure, the swing angle may be the same.

As described above, as to the Y-, M-, and C-color recording heads, the radius rb of the arc-shaped moving locus of the other or second end is greater than the radius ra of the moving locus of the first end.

Figure 15:
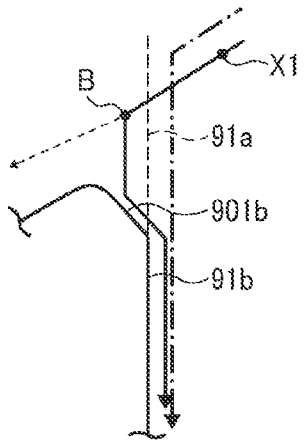
FIG. 15 shows a moving locus of the first rotary member at the first end and the second end of the recording head, when a radius of the arc-shaped moving locus of the second end is made greater than that of the arc-shaped moving locus of the first end.
Figure 16:
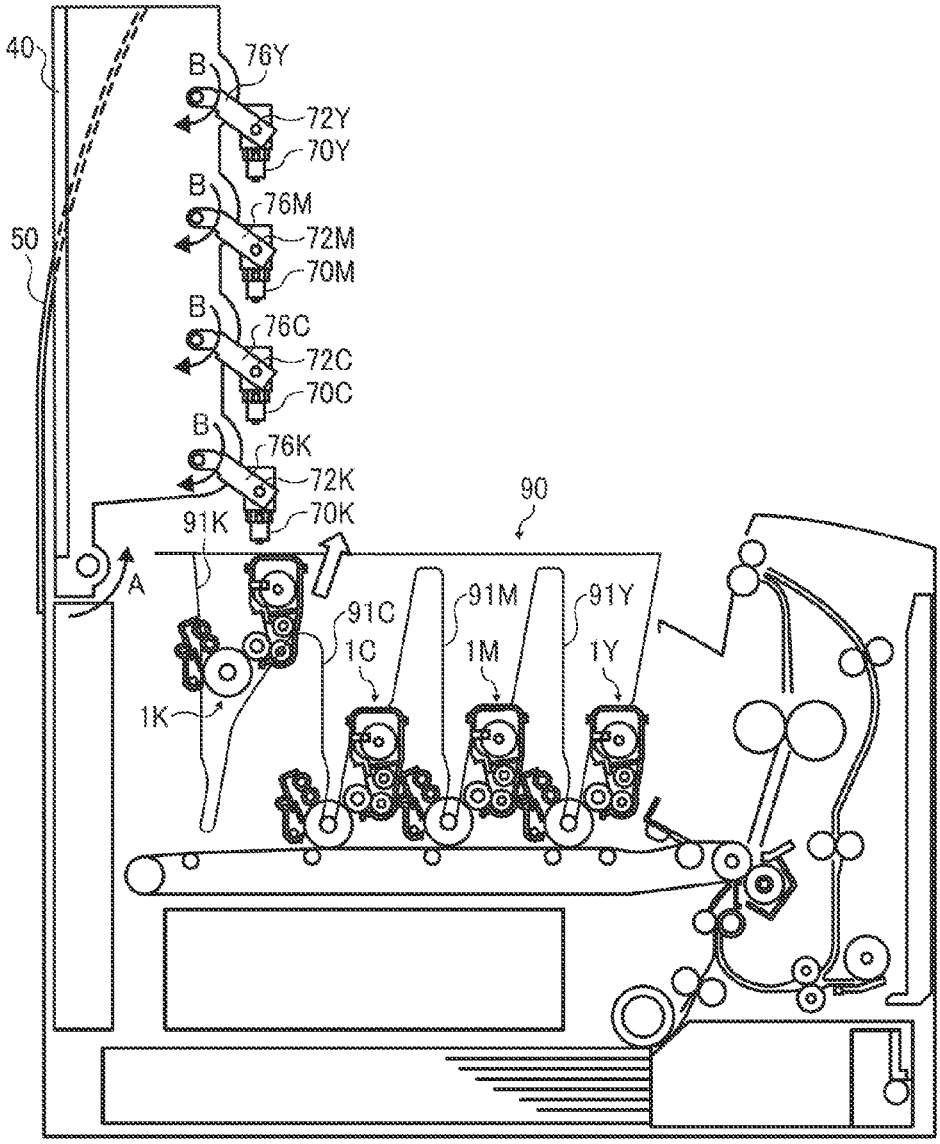
FIG. 16 BACKGROUND ART
FIG. 16 is a view illustrating an image forming apparatus as background art.

FIG. 15 shows a moving locus of the first rotary member 72*a* at the first end and the first rotary member 72*b* at the second end of the recording head, when a radius rb of the arc-shaped moving locus of the second end is made greater than the radius ra of the arc-shaped moving locus of the first end.

As illustrated in FIG. 15, the first rotary member 72*a* at the first end contacts the guide member 91*a* at the first end, the first rotary member 72*b* at the second end is positioned at a point X1 at a side of the sheet conveyance path than the first rotary member 72*a* at the first end. From this state, when the inner cover 40 is being closed, the first rotary member 72*b* at the second end, while taking an arc-shaped moving locus, moves leftward and the first rotary member 72*b* at the first end moves downward in the figure. With this structure, an imbalance of the recording head 70 with the head holder 71 is adjusted and the slant in the main scanning direction between the recording head 70 and the head holder 71 is reduced. In the structure as illustrated in FIG. 12 in which the arc-shaped moving loci at the first end and the second end are the same, the recording head 70 and the head holder 71 are twisted, but in the example as illustrated in FIG. 15, the twist is eliminated. Then, the contact pressure between the first rotary member 72*a* at the first end the guide member 91*a* at the first end is reducing. As a result, a load to close the inner cover 40 is reduced. Then, after the first rotary member 72*b* at the second end comes to a position B in FIG. 15 along an arc-shaped moving locus, similarly to the case of FIG. 12, a pressing force of the torsion spring 78*a* of the first end, resilience of the heat holder 71 and the recording head 70, the pressing force of the torsion spring 78*b* of the second end are applied to the guide member 91*a* of the first end. Difference from the structure as illustrated in FIG. 12 is that the first rotary member 72*b* at the second end moves downward linearly in a short time of period. Accordingly, the pressing force of the torsion spring 78*b* of the second end applied to the guide member 91*a* at the first end is lower than the example as illustrated in FIG. 12. Then, compared to the structure as illustrated in FIG. 12, the contact pressure to the guide member 91*a* at the first end is reduced, thereby reducing the load to close the inner cover 40.

Then, when the first rotary member 72*b* at the second end contacts the guide member 91*a* of the second end, the slanted angle in the main scanning direction of the recording head 70 and the head holder 71 is corrected and the recording head positioned at each latent image forming position is aligned to parallel to the main scanning direction.

Further, in the present embodiment, the drive transmitter 80 to transmit a driving force to the toner bottle is disposed above the guide member 91*b* at the side plate 90*b* of the second end. But the driving means is not limited to this, and, for example, a control board may be disposed above the guide member 91*b* at the side plate 90*b*.

The aforementioned embodiments are examples and the present invention includes special features for each aspect of the exemplary embodiments (1) to (13):

(1) An image forming apparatus includes: a latent image carrier such as a photoreceptor 2; a latent image forming device such as a recording head 70 to form a latent image on the surface of the latent image carrier; a housing 90 including an opening; and a holder such as an inner cover 40 holding a latent image forming device, and the inner cover is swingably supported about one end relative to the housing. When the inner cover 40 rotates about a supporting center, the recording head 70 is moved between the latent image forming position and a retracted position. The image forming apparatus further includes a first guide member 91*a* to guide the recording head longitudinal end at a first end to the latent image forming position while regulating a movement of the recording head 70 in the vertical direction and a second guide member 91*b* at a second end to guide the recording head longitudinal end at a second end, and the length of the second guide member 91*b* from the latent image forming position to an end toward the opening is shorter than the length of the first guide member 91*a* from the latent image forming position to the end toward the opening of the apparatus.

Because the present invention includes the above structure, as described in the above embodiments, a space is created above the guide member 91*b* at the second end and the drive transmitter 80 and the like can be disposed in the created space. With this configuration, the apparatus can be formed into a compact. Further, the latent image forming device can be optimally guided at the latent image forming position in the housing of the apparatus.

(2) In addition, in the image forming apparatus as configured as in (1), a slanted portion 901*b* slanted toward the rotary supporting point of the holder or the inner cover 40 is disposed at a leading end of the second guide member 91*b*.

With this structure, as described in the above embodiments, the slanted portion 901*b* allows the latent image forming device at the second end to guide to the second guide member 91*b*. With this structure, the guide members 91*a*, 91*b* at both lateral ends can guide the latent image forming device to the latent image forming position smoothly.

(3) In addition, in the image forming apparatus as claimed in (1) or (2), a radius rb of the arc-shaped moving locus of the recording head 70, at a side guided by the second guide member 91*b*, rotating about the rotation supporting center of the inner cover 40 as a holder is greater than a radius ra of the arc-shaped moving locus of the recording head 70, at a side guided by the first guide member 91*a*, rotating about the rotation supporting center of the inner cover 40.

With this structure, as described in the embodiment section, a load to open or close the inner cover is reduced.

(4) In the image forming apparatus as described in the above (3), the latent image forming device such as the recording head 70 moves between the latent image forming position and the retracted position so as to be inclined in the main scanning direction in the retracted position and parallel to the main scanning direction in the latent image forming position.

With this structure, as described in the embodiment section, the moving loci of the latent image forming device are made different between the first end and the second end. In addition, because in the latent image forming position, the latent image forming device is positioned parallel to the main scanning direction, the latent image on the latent image carrier is prevented from slanting.

(5) In the image forming apparatus as configured in the above (4), the latent image forming device such as the recording head 70 is held by the holder such as the inner cover 40 in a state slanting in the main scanning direction, and the slant in the main scanning direction of the latent image forming device is corrected by the first side guide member 91*a* and the second side guide member 91*b*.

With this structure, as described in the embodiment section, the latent image forming device can be slanted toward the main scanning direction in the retracted position and can be made parallel to the main scanning direction in the latent image forming position.

(6) In the image forming apparatus as described in the above (5), the longitudinal lateral ends of the latent image forming device such as the recording head 70 are swingably held relative to the holder such as the inner cover 40 and the swingable range of the latent image forming device at the first end relative to the holder is narrower than the latent image forming device at the second end.

With this structure, as described in the embodiment section, the latent image forming device slanted in the main scanning direction at the retracted position can be corrected to be parallel to the main scanning direction by the lateral guide members 91*a*, 91*b*.

(7) In the image forming apparatus as described in the above (6), a torsion spring 78 as a pressing means to press the latent image forming device such as the recording head 70 toward one direction against the holder such as the inner cover 40.

With such a structure, as described in the embodiment section, even an impact or vibration occurs to the apparatus while the latent image forming device such as the recording head 70 is moving between the latent image forming position and the retracted position, the latent image forming device is prevented from separating from the guide member. As a result, even when the latent image forming device moves from the latent image forming position to the retracted position or vice versa, collisions of the latent image forming device with a part in the housing may be restricted.

(8) In the image forming apparatus as described in the above (6) or (7), a regulating device to prevent oscillation of the latent image forming device such as the recording head 70 relative to the holder such as the inner cover 40 is disposed.

With such a structure, as described in the embodiment section, even when the vibration of the apparatus occurs, the regulating device can prevent the arm member to swing exceeding the predetermined angle and the recording head 70 from striking the parts inside the apparatus housing.

(9) In the image forming apparatus as described in any of the above (1) through (8), at least one of the first guide member and the second guide member is integrally formed with the housing.

With this structure, as described in the embodiment section, compared to the case in which the guide member and the housing are separately constructed, the number of parts can be reduced and a cost-effective apparatus can be formed.

(10) In addition, in the image forming apparatus as described in any of the above (1) through (8), at least one of the first guide member and the second guide member is separately formed from the housing.

With such a structure, compared to the case in which the guide member is integrally formed with the housing, the freeness in the design of the guide member can be improved.

(11) In the image forming apparatus as described in any one of the above (1) to (10), at least one of the members such as the image forming unit 1 disposed in the housing 90 is detachable from an opening of the housing 90.

With such a structure, the member disposed in the housing can be replaced easily.

(12) In addition, in the image forming apparatus as described in the above (1) to (11), the latent image forming device such as the recording head is configured such that a plurality of light-emitting elements are aligned in the shaft direction of the latent image carrier and the light-emitting elements employ an LED or organic EL element.

(13) In the image forming apparatus as described in any one of the above (1) to (12), a recording sheet conveyance direction in the housing is a direction perpendicular to the open surface of the opening of the housing, wherein a rotation supporting point of the holder such as the inner cover 40 is disposed at an end opposite the sheet conveyance area in the housing.

With such a structure, as described in the embodiment section, the length of the upper cover as a holder can be shortened compared to the structure in which the rotation supporting point of the cover is disposed at the end in the recording sheet conveyance area. Without securing a large space above the guide member, the cover can be opened so that the entire apparatus can be made cost effectively. Further, even when paper jamming occurs in the recording sheet conveyance path, the cover does not disturb the jam handling operation. No consideration as to the disturbance of the cover against the recording sheet conveyance path is required. Further, the construction of the inner cover can be simplified, and as a result, cost rise can be prevented. The apparatus can be formed into a compact shape and the image forming apparatus in which each latent image carrier can be guided to the latent image forming position optimally is provided.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

a latent image carrier;

a latent image forming device configured to form a latent image on a surface of the latent image carrier;

a housing including an opening, the latent image carrier and the latent image forming device being accommodated in the housing;

a holder swingably supporting the latent image forming device, the holder being swingably supported about an end thereof relative to the housing and moving the latent image forming device between a latent image forming position and a retracted position;

a first guide member at a first end extending from the latent image forming position to the opening of the housing and configured to guide the latent image forming device longitudinal first end to the latent image forming position while regulating movement of the latent image forming device in a vertical direction; and a second guide member at a second end extending from the latent image forming position to the opening of the housing and configured to guide the latent image forming device longitudinal second end to the latent image forming position while regulating movement of the latent image forming device in the vertical direction, wherein the length of the second guide member from the latent image forming position to an end toward the opening is shorter than the length of the first guide member from the latent image forming position to the end toward the opening of the housing, and wherein a radius rb of the arc-shaped moving locus of the latent image forming device, at a side guided by the second guide member, rotating about the rotation supporting center of the holder is greater than a radius ra of the arc-shaped moving locus of the latent image forming device, at a side guided by the first guide member, rotating about the rotation supporting center of the holder.

2. An image forming apparatus as claimed in claim 1, further comprising a slanted portion slanted toward a rotation supporting point of the holder and disposed at a leading end of the second guide member.

3. An image forming apparatus as claimed in claim 1, wherein the latent image forming device moves between the latent image forming position and the retracted position so as to be inclined in a main scanning direction in the retracted position and parallel to the main scanning direction in the latent image forming position.

4. An image forming apparatus as claimed in claim 3, wherein the latent image forming device is held by the holder in a state slanting in the main scanning direction, and the slant in the main scanning direction of the latent image forming device is corrected by the first side guide member and the second side guide member.

5. An image forming apparatus as claimed in claim 4, wherein the longitudinal lateral ends of the latent image forming device are swingably held relative to the holder and the swingable range of the latent image forming device at the first end relative to the holder is narrower than the range of the latent image forming device at the second end.

6. An image forming apparatus as claimed in claim 5, further comprising a torsion spring to press the latent image forming device toward one direction against the holder.

7. An image forming apparatus as claimed in claim 5, further comprising a regulating device to prevent oscillation of the latent image forming device relative to the holder.

8. An image forming apparatus as claimed in claim 1, wherein at least one of the first guide member and the second guide member is continuous with the housing.

9. An image forming apparatus as claimed in claim 1, wherein at least one of the first guide member and the second guide member is separate from the housing.

10. An image forming apparatus as claimed in claim 1, wherein at least one of the members disposed in the housing is detachable from the apparatus through the opening in the housing.

11. An image forming apparatus as claimed in claim 1, further comprising a plurality of light-emitting elements employing an LED or an organic EL element, wherein the plurality of light-emitting elements are aligned parallel to the shaft of the latent image carrier.

12. An image forming apparatus as claimed in claim 1, wherein a recording sheet conveyance direction in the housing is a direction perpendicular to the open surface of the opening of the housing, wherein a rotation supporting point of the holder is disposed at an end opposite the sheet conveyance area in the housing.

13. An image forming apparatus comprising:

a latent image forming device configured to form a latent image;

a holder swingably supporting the latent image forming device, the holder being swingably supported about an end thereof relative to the housing and moving the latent image forming device between a latent image forming position and a retracted position;

a first guide member at a first end extending from the latent image forming position and configured to guide the latent image forming device longitudinal first end to the latent image forming position while regulating movement of the latent image forming device in a vertical direction; and a second guide member at a second end extending from the latent image forming position and configured to guide the latent image forming device longitudinal second end to the latent image forming position while regulating movement of the latent image forming device in the vertical direction, wherein the length of the second guide member is shorter than the length of the first guide member, and wherein a radius rb of the arc-shaped moving locus of the latent image forming device, at a side guided by the second guide member, rotating about the rotation supporting center of the holder is greater than a radius ra of the arc-shaped moving locus of the latent image forming device, at a side guided by the first guide member, rotating about the rotation supporting center of the holder.

14. An image forming apparatus as claimed in claim 13, further comprising a slanted portion slanted toward the rotation supporting point of the holder and disposed at a leading end of the second guide member.

15. An image forming apparatus as claimed in claim 13, wherein the latent image forming device moves between the latent image forming position and the retracted position so as to be inclined in a main scanning direction in the retracted position and parallel to the main scanning direction in the latent image forming position.

16. An image forming apparatus as claimed in claim 15, wherein the latent image forming device is held by the holder in a state slanting in the main scanning direction, and the slant in the main scanning direction of the latent image forming device is corrected by the first side guide member and the second side guide member.

17. An image forming apparatus as claimed in claim 16, wherein the longitudinal lateral ends of the latent image forming device are swingably held relative to the holder and the swingable range of the latent image forming device at the first end relative to the holder is narrower than the range of the latent image forming device at the second end.

18. An image forming apparatus as claimed in claim 16, further comprising a torsion spring to press the latent image forming device toward one direction against the holder.

19. An image forming apparatus as claimed in claim 16, further comprising a regulating device to prevent oscillation of the latent image forming device relative to the holder.

20. An image forming apparatus as claimed in claim 13, wherein at least one of the first guide member and the second guide member is continuous with the housing.

21. An image forming apparatus as claimed in claim 13, wherein at least one of the first guide member and the second guide member is separate from the housing.

22. An image forming apparatus as claimed in claim 13, wherein at least one of the members disposed in the housing is detachable from the apparatus through the opening in the housing.

23. An image forming apparatus as claimed in claim 13, further comprising a plurality of light-emitting elements employing an LED or an organic EL element, wherein the plurality of light-emitting elements are aligned parallel to the shaft of the latent image carrier.

24. An image forming apparatus as claimed in claim 13, wherein a recording sheet conveyance direction in the housing is a direction perpendicular to the open surface of the opening of the housing, wherein a rotation supporting point of the holder is disposed at an end opposite the sheet conveyance area in the housing.

* * * * *